US007648224B2

(12) United States Patent
Sasa et al.

(10) Patent No.: US 7,648,224 B2
(45) Date of Patent: Jan. 19, 2010

(54) INKJET RECORDING APPARATUS

(75) Inventors: Masahiko Sasa, Nagoya (JP); Masaru Takeuchi, Handa (JP); Kohei Terada, Nagoya (JP); Nobuo Hiraki, Nagoya (JP); Ryohei Suzuki, Nagoya (JP)

(73) Assignee: Brother Kogyo Kabuhsiki Kaisha, Nagoya-shi, Aichi-ken (JP)

( * ) Notice: Subject to any disclaimer, the term of this patent is extended or adjusted under 35 U.S.C. 154(b) by 441 days.

(21) Appl. No.: 11/380,866

(22) Filed: Apr. 28, 2006

(65) Prior Publication Data

US 2006/0244799 A1 Nov. 2, 2006

(30) Foreign Application Priority Data

Apr. 28, 2005 (JP) ..... 2005-132195

(51) Int. Cl.
*B41J 2/165* (2006.01)
*B41J 2/17* (2006.01)
*B41J 2/175* (2006.01)
*B41J 2/18* (2006.01)

(52) U.S. Cl. ..... 347/36; 347/84; 347/85; 347/89

(58) Field of Classification Search ..... 347/7, 347/29, 36, 84–85, 89
See application file for complete search history.

(56) References Cited

U.S. PATENT DOCUMENTS 5,801,736 A 9/1998 Ikkatai et al.
6,273,545 B1 8/2001 Oide
6,283,585 B1 9/2001 Ikkatai et al.
6,679,574 B2 * 1/2004 Sato ..... 347/7
2003/0007023 A1 * 1/2003 Barclay et al. ..... 347/8
2003/0137575 A1 * 7/2003 Peterson et al. ..... 347/121
2005/0057586 A1 * 3/2005 Brenner ..... 347/7

FOREIGN PATENT DOCUMENTS

JP 61002563 A * 1/1986 ..... 347/7
JP H4 364960 12/1992
JP H8 132640 5/1996
JP H11 170573 6/1996
JP 2000 272144 10/2000
JP 2000 309111 11/2000
JP 2003 334972 11/2003
JP 2004136482 A * 5/2004 ..... 347/29
JP 2004 174773 6/2004

* cited by examiner

*Primary Examiner*—Julian D Huffman
*Assistant Examiner*—Jason S Uhlenhake
(74) *Attorney, Agent, or Firm*—Baker Botts L.L.P.

(57) ABSTRACT

An inkjet recording apparatus that records an image on a recording medium including: at least one recording head for unused-ink having a nozzle array made of a plurality of nozzles that selectively ejects unused-ink; at least one recording head for recycled-ink having a nozzle array made of a plurality of nozzles that selectively ejects recycled-ink of an equivalent color to the unused-ink ejected from the recording head for unused-ink; a collector that collects ink discharged from the recording head for unused-ink and the recording head for recycled-ink so as to restore an ejectable state of the recording heads; and a recycled-ink supplier that supplies ink, collected by the collector, to the recording head for recycled-ink as recycled-ink.

9 Claims, 17 Drawing Sheets

RECORDING HEAD FOR UNUSED-INK

RECORDING HEAD FOR RECYCLED-INK

INKJET RECORDING APPARATUS

CROSS-REFERENCE TO RELATED APPLICATIONS

This application claims the benefit of Japanese Patent Application No. 2005-132195 filed Apr. 28, 2005 in the Japan Patent Office, the disclosure of which is incorporated herein by reference.

BACKGROUND

This invention relates to an inkjet recording apparatus. Particularly, the present invention relates to technique for reusing ink ejected when nozzle maintenance is performed.

An inkjet recording apparatus has already been achieved wherein color recording is possible with a plurality of colors of ink (for example, black (to be referred to as "K"), cyan (to be referred to as "C"), magenta (to be referred to as "M"), and yellow (to be referred to as "Y")). In such an inkjet recording apparatus, nozzles from which a respective color of ink is ejected are provided on a recording head. Ink is selectively ejected from each nozzle onto a recording medium so as to record an image on the recording medium.

However, it is known that nozzles of this kind of inkjet recording apparatus go into an unejectable state, wherein nozzles are blocked when dust or air enters the nozzles or when the ink inside of the nozzles becomes dried and solidified. In order to restore a normal state of nozzles from such an unejectable state, various maintenance operations are performed, such as a vacuum purging, purging with positive pressure, and flushing. When such maintenance operations are performed, unused-ink is forcibly ejected for the purpose of removing dust, air, and solidified ink from the inside of the nozzles. The ejected ink is conventionally discarded by being stored in a waste ink reservoir or absorbed into a waste ink absorber.

If a large amount of ink is discarded without being used for recording, because of the maintenance operations described above, the amount of ink that can be used for recording inevitably decreases. There has been a problem in that the running cost, such as for ink, becomes higher.

A technique for collecting and reusing waste ink has been devised. In an inkjet recording apparatus with this technique, virgin-inks C, M, and Y, which have not been used yet, are used for recording. As for ink K, a processed ink, wherein C, M, and Y, are blended, is used for recording. This inkjet recording apparatus is provided with recording heads for respective colors of ink C, M, and Y, and a recording head for the processed black ink. When ink is ejected from each recording head due to a maintenance operation, ink is collected by a cap. Dust and air bubbles are removed from the collected ink via a filter. Diluting-fluid is added to the collected ink so as to adjust the viscosity. The diluted ink is supplied to the recording head for the processed black ink and reused.

However, the above-described inkjet recording apparatus is provided with only one recording head for ink K (i.e. for the processed black ink). Since processed black ink (made of C, M, and Y, blended together) is used as ink K, the actual color of ink K sometimes does not appear black depending on the mixture ratio of each color of ink blended therein. When such blended ink is used for image recording, the quality of an image might be deteriorated.

Moreover, because the processed black ink is made of ink C, M, and Y, causing a large consumption of processed black ink for black-and-white image recording, such as for text-image formation or facsimile-data image formation, causes the quick consumption of a large amount of ink C, M, and Y. These colors of ink might run out before color image recording is performed. Using color ink for black-and-white image recording might cause an increase in ink cost.

SUMMARY

In one aspect of the present invention, in addition to a recording head for unused-ink (virgin-ink) (to be referred to as head V (virgin-ink)), an inkjet recording apparatus may be preferably provided with another recording head for reused-ink (recycled-ink) of an equivalent color (to be referred to as head R (recycled-ink)). In the inkjet recording apparatus, consumption of ink can be preferably saved by reusing the ink discharged during a maintenance operation.

In the one aspect of the present invention, an inkjet recording apparatus includes at least one recording head for unused-ink (virgin-ink), and at least one recording head for reused-ink (recycled-ink) of an equivalent color to the unused-ink.

Both of the above-described recording heads respectively have a nozzle array including a plurality of nozzles from which ink can be selectively ejected. The inkjet recording apparatus described above performs the recording of an image on a recording medium with these recording heads. The recording head for unused-ink (to be referred to as head V) ejects unused-ink. The recording head for recycled-ink (to be referred to as head R) ejects recycled-ink of an equivalent color to the ink ejected from the head V. The inkjet recording apparatus furthermore includes a collector and a recycled-ink supplier. The collector collects ink discharged from the head V and the head R in order to restore an ink-ejectable state of the recording heads. The recycled-ink supplier supplies the ink collected by the collector to the head R as recycled-ink.

It is to be noted that the "ink discharged in order to restore an ink-ejectable state" mentioned above indicates ink discharged during the various maintenance operations in the recording heads, such as suction purging, purging with positive pressure, or flushing (all together simply referred to as "a maintenance operation"). It is also to be noted that "an equivalent color" mentioned above includes not only the meaning of "an identical color", but also includes a meaning of "a similar color" that is not exactly identical with an original color but can be used as a substitute for the original color.

With the above-described inkjet recording apparatus, ink, discharged during a maintenance operation, can be reused and the ink can be saved. Moreover, since the head R for recycled-ink of an equivalent color to the unused-ink contained in the head V is provided, image recording can be performed with the recycled-ink stored in the head R even when the unused-ink runs out. Furthermore, unused-ink and recycled-ink can be selectively used depending on the situation. For example, unused-ink from the head V can be used for high quality image recording. Recycled-ink from the head R can be used for lower quality image recording. Additionally, image recording can be performed with high speed by simultaneous ejection of ink in the equivalent color from the head V and the head R.

BRIEF DESCRIPTION OF THE DRAWINGS

The invention will now be described below, by way of example, with reference to the accompanying drawings, in which:

FIGS. 3A and 3B are sectional block diagrams in which FIG. 3A shows a head V for ink K, and FIG. 3B shows a head R for ink RK;

DETAILED DESCRIPTION OF THE PREFERRED EMBODIMENT

Overall Structure of Inkjet Recording Apparatus 1

Figure 1:
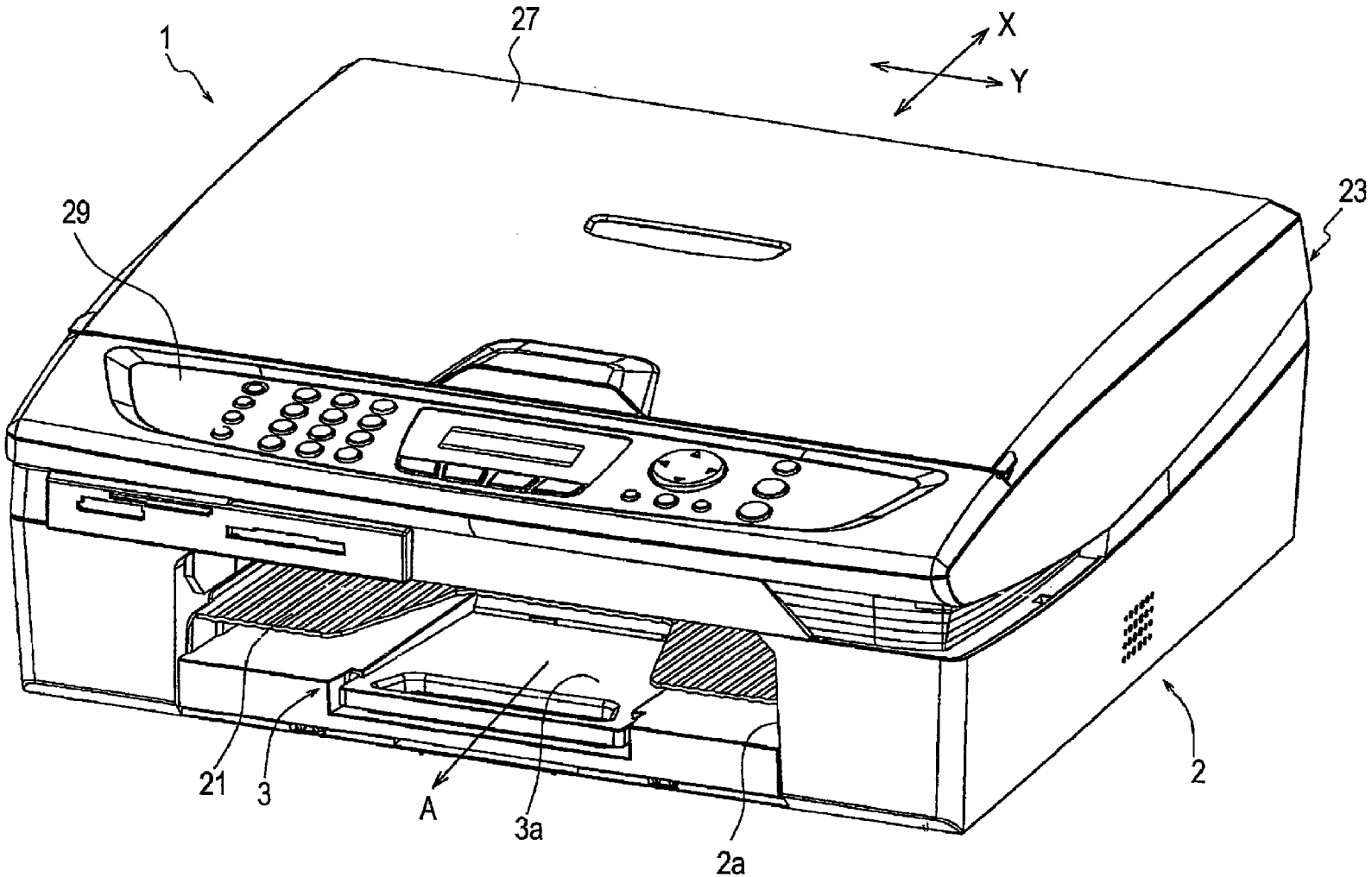
FIG. 1 is a perspective view showing a multifunction apparatus to which the present invention is preferably applicable.

Referring to FIG. 1, an inkjet recording apparatus 1 is a multifunction device that serves as a printer, a copier, a scanner, and a facsimile. A sheet of paper or plastic film is used as a recording medium.

The inkjet recording apparatus 1 is provided with a housing 2, a paper feed cassette 3, and a paper discharge unit 21. The housing 2 is made of synthetic resin. The paper feed cassette 3 is provided in a bottom portion of the housing 2. The paper feed cassette 3 can be inserted into an opening 2*a* formed in the front side of the housing 2. The paper discharge unit 21 is provided over the paper feed cassette 3. Paper on which recording is performed is discharged onto the paper discharge unit 21 in the direction indicated by Arrow A. A paper exit, communicated with the paper discharge unit 21, is provided in a upper portion of the opening 2*a* in the front side of the housing 2.

The paper feed cassette 3 can store a plurality of sheets of paper that are cut into, for example, A4 size, letter size, legal size, or postcard size. Each sheet of paper is placed in a manner so that the long side of the paper is placed in parallel to a paper conveyance direction (a sub-scanning direction, or an x-axis direction). An auxiliary support member 3*a*, which can be extended in the x-axis direction, is attached to the front end of the paper feed cassette 3 so as to support a trailing end of a long sheet of paper, such as for the legal size. When paper can be stored within the paper feed cassette 3, such as paper in an A4 size, the auxiliary support member 3*a* is stored into the front portion of the paper feed cassette 3 in a manner so that the stored auxiliary support member 3*a* does not interrupt the paper feed.

An image reading device 23 is provided in the upper portion of the housing 2. The image reading device 23 is used so as to read an original image when the inkjet recording apparatus 1 works as a copier or a facsimile. The image reading device 23 is rotatable on a shaft (not shown) in an up-and-down direction with respect to one side of the housing 2, and can be opened and closed. A cover 27 is provided on the top portion of the image reading device 23. The cover 27 covers an original image placed on the top surface of the image reading device 23. The cover 27 is rotatable in the up-and-down direction on a shaft (not shown) provided on the rear end of the image reading device 23.

For reading an image, the cover 27 is lifted upward and opened. An original image is placed on a glass board for original image placement. While the original image is placed on the glass board, a contact image sensor, which is disposed under the glass board so as to be able to be reciprocated in a y-axis direction (a main scanning direction), scans the original image and reads the image.

An operation panel 29, having various operation buttons and a liquid crystal display, is provided in front of the cover 27 on the top surface of the image reading device 23.

A recording unit (not shown), constituted with a carriage 112 (see FIG. 5) and other mechanisms, is provided inside of the housing 2. The carriage 112 carries inkjet recording heads that realize the printing performance of the inkjet recording apparatus 1. The carriage 112 can be reciprocated in the y-axis direction (the main scanning direction).

In the recording unit, the carriage is controlled by a control unit 100 (see FIG. 5) constituted with a CPU and the like and reciprocated in the y-axis direction (the main scanning direction) so as to move the recording heads. While the recording heads are being moved, ink is ejected onto paper that is placed stationary under the recording heads. An image is recorded on the paper.

Moreover, a maintenance unit (not shown) is provided at a position that corresponds to a standby position of the carriage in the recording unit. In the maintenance unit, various maintenance operations, such as wiping for wiping the nozzle surfaces of the recording heads with a blade, purging for forcibly removing dust, air, or solidified ink, and flushing, are performed.

Furthermore, an ink reservoir unit is provided inside of the housing 2. Ink cartridges and a recycled-ink tank are provided in the ink reservoir unit. Each ink cartridge stores unused-ink of one of the four colors (black (K), cyan (C), magenta (M) and yellow (Y)) for full-color recording. The recycled-ink tank stores ink collected from the recording heads due to maintenance operations. The ink cartridge can be attachable from above and detachable upwardly with respect to the ink reservoir unit. In order to replenish ink, the entire ink cartridge is replaced.

First Embodiment

Figure 2:
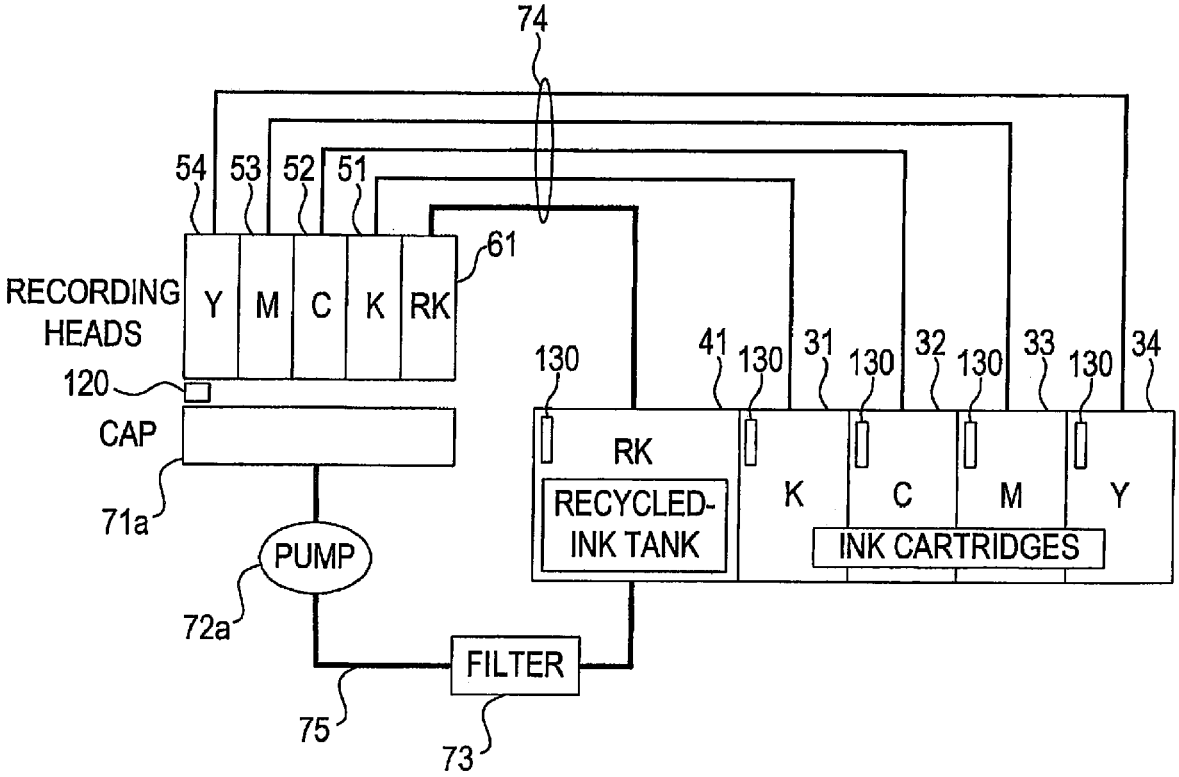
FIG. 2 is a block diagram showing a schematic structure of a main part of an inkjet recording apparatus according to a first embodiment of the present invention.

Referring now to FIG. 2, the inkjet recording apparatus 1 according to a first embodiment is provided with ink cartridges 31, 32, 33, and 34, and a recycled-ink tank 41 in the above-described ink reservoir unit. Each of the ink cartridges 31-34 stores one of unused-inks K, C, M and Y. The recycled-ink tank 41 is for storing recycled black ink (to be referred to as "RK"). The inkjet recording apparatus 1 is furthermore provided with recording heads 51, 52, 53 and 54 respectively for unused-ink K, C, M, and Y (heads V), and a recording head 61 for ink RK (head R) on the carriage in the above-described recording unit. Still furthermore, the inkjet recording apparatus 1 is provided with a cap 71*a*, a pump 72*a*, a filter 73, and a collected-ink path 75, in the above-described maintenance unit. Additionally, the inkjet recording apparatus 1 is provided with ink supply tubes 74. It is to be noted that all of the unused-inks K, C, M, and Y, are dye ink.

The cap 71*a* is attached to all the recording heads 51-54 and 61 when recording is not performed and covers the nozzle surfaces of recording heads 51-54 and 61 so as to inhibit the drying of the ink inside of each recording head. When the pump 72*a* is driven while the cap 71*a* is attached to the recording heads 51-54 and 61, ink can be drawn from nozzles of each recording head. As result of this operation, impure substances, air bubbles, and solidified ink accumulated inside of the nozzles of the recording heads 51-54 and 61, can be discharged from the recording heads 51-54 and 61 into the cap 71*a* (purging). Ink ejected from the recording heads 51-54 and 61 due to flushing can be received in the cap 71*a*. Ink inside of the cap 71*a* can be collected by the pump 72*a*. It is to be noted that the cap 71*a* receives, in bulk, all of the ink K, C, M, and RK discharged from the respective recording heads 51-54 and 61.

Ink discharged into the cap 71*a* is collected by the pump 72*a* when the pump 72*a* is driven. Collected ink of respective colors K, C, M, Y, and RK are mixed together. The amount of ink of the respective colors discharged from each of the recording heads 51-54 and 61 when purging and flushing are performed is virtually equivalent to one another. Thus, the mixed ink becomes a black color ink. In the inkjet recording apparatus 1 according to the present embodiment, the mixed ink is recycled and used as ink RK for image recording.

Collected ink flows in the collected ink path 75 and is filtered through the filter 73. Impure substances and air bubbles contained in the collected ink are removed. Then, the collected ink is stored in the recycled-ink tank 41 as ink RK.

The recycled-ink tank 41 and ink cartridges 31-34 in the ink reservoir unit are respectively communicated with the head R 61 and the heads V 51-54 on the carriage of the recording unit via the ink supply tubes 74. Ink stored in the recycled-ink tank 41 and the ink cartridges 31-34 for unused-ink is supplied to the respective recording heads 51-54 and 61 through the ink supply tubes 74. The ink supply tube 74 for ink RK has a larger diameter as compared to the other ink supply tubes 74 for unused-ink. This is based on an assumption that the viscosity of ink RK increases because ink RK is made of ink that has already been discharged once due to a maintenance operation, and the diluting-fluid contained therein evaporates. In other words, by providing the ink supply tube 74 for ink RK with a larger diameter than the other ink supply tubes 74, an increase of the flow resistance, which can be caused due to a viscosity increase, can be prevented. Consequently, recycled-ink can flow in the ink supply tube 74 in a stable manner although the viscosity of such ink has been increased.

Figure 3A:
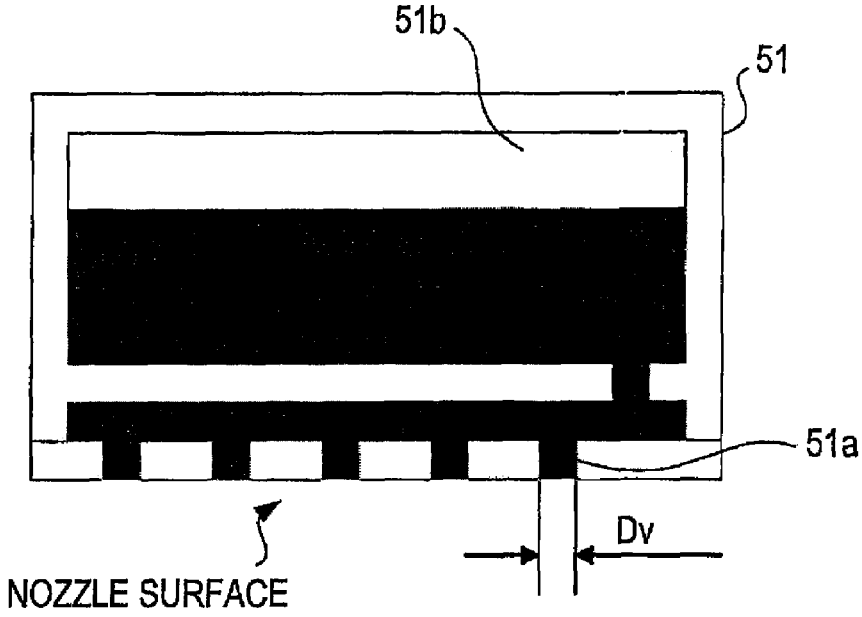
Figure 3B:
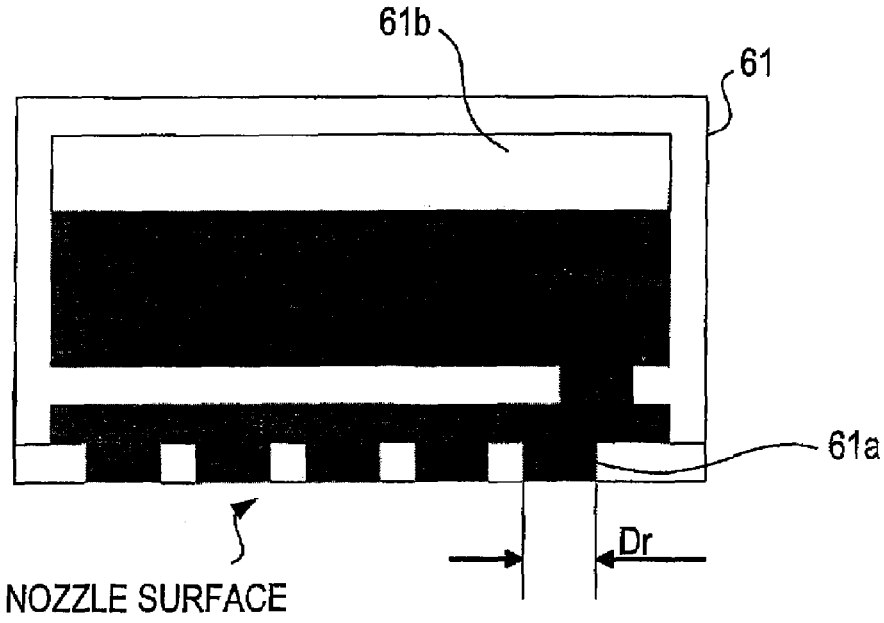

As shown in FIGS. 3A and 3B, sub-tanks 51*b* and 61*b* are respectively incorporated in the recording heads 51 and 61. The sub-tanks 51*b* and 61*b* store ink supplied through the ink tubes 74 (see FIG. 2). In the lower side of sub-tank 51*b* and 61*b*, nozzles 51*a* and 61*a* are respectively aligned for ejecting ink. It is to be noted that the other heads V 52-54 have the same structure as the structure of the head V 51 for ink K.

The diameter (Dr) of the nozzles 61*a* of the head R 61 is larger than the diameter (Dv) of the nozzles 51*a* of the head V 51. This is based on the assumption that ink RK ejected from the head R 61 has a different ejection characteristic from the characteristics of unused-ink, because the viscosity of ink RK is higher due to the volatilization of the diluting-fluid contained in the ink. By making the diameter (Dr) of the nozzles 61*a* of the head R 61 larger than the diameter (Dv) of the nozzles 51*a* of the head V 51, the recycled-ink can be ejected in a stable manner although the viscosity of the recycled-ink has been increased. A suitable size for the diameter (Dr) can be calculated according to Hagen-Poiseuille Equation with the expected increased viscosity of the recycled-ink. Specifically, if the diameter (Dv) of the nozzles 51*a* of the head V 51 is 20 μm, the diameter (Dr) of the nozzles 61*a* of the head R 61 can be a few μm to several tens of μm larger than Dv in consideration of the increased viscosity of recycled-ink.

Figure 4:
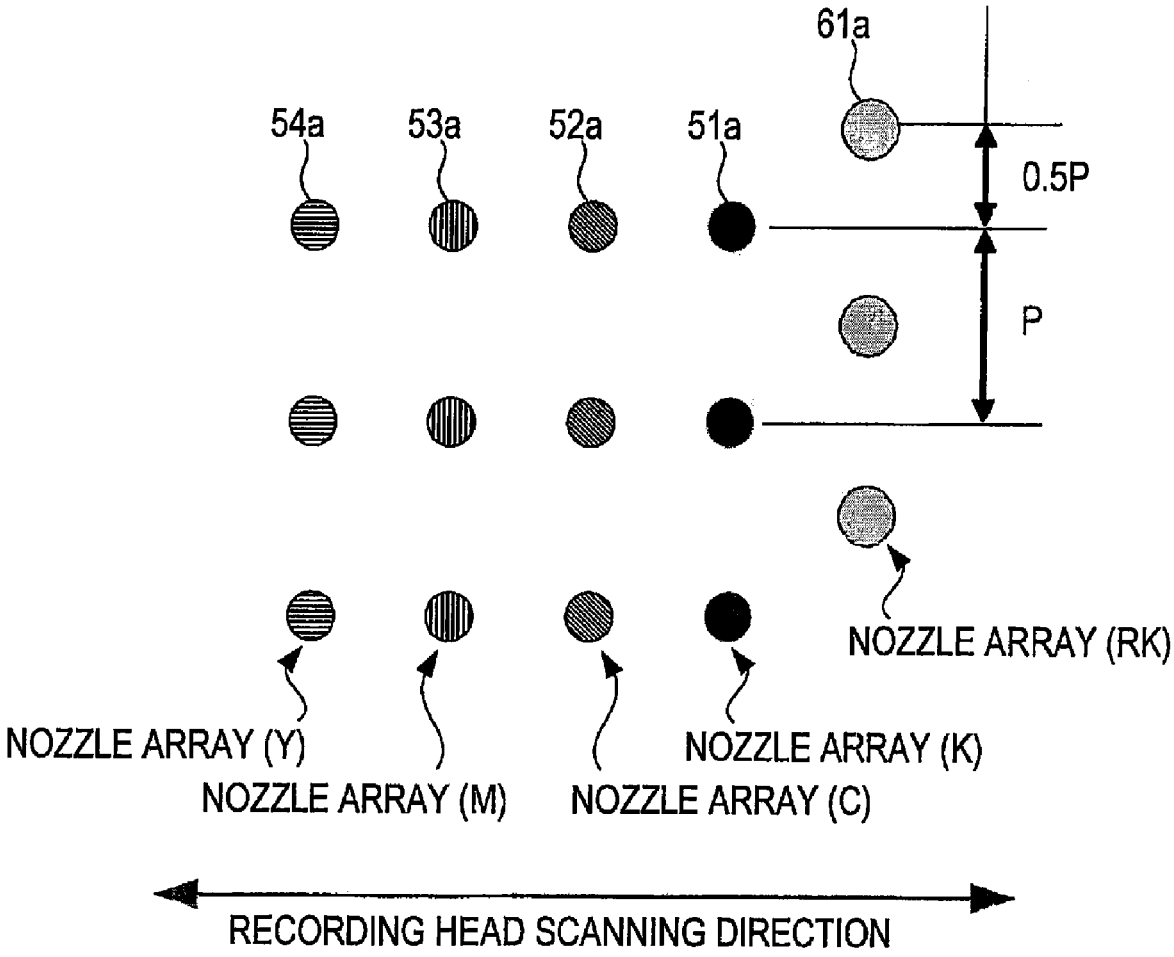
FIG. 4 is a schematic view showing a disposition of nozzle arrays of respective recording heads in the inkjet recording apparatus according to the first embodiment.

As shown in FIG. 4, the arrays of nozzles of the recording heads 51-54 and 61 are disposed along the scanning direction of the recording heads 51-54 and 61 in the order of nozzle array Y, M, C, K, and RK, from the left side. The arrays Y, M, C, K, and RK, are disposed in parallel to one another. The positions of nozzles 61*a* in the nozzle array RK of the head R 61 are displaced off of the positions of the nozzles 51*a* in the adjacent nozzle array K of the head V 51 in the direction of the alignment for half (0.5 P) of the interval P between the nozzles 51*a*.

Because of the positions of the nozzles 61*a* being displaced off by 0.5 P, when ink K and ink RK are simultaneously ejected from the head V 51 and the head R 61 for image recording, the image recording can be performed more minutely, as compared to a case wherein ink is ejected from only one of the head V 51 and the head R 61. The quality of image recording can be substantially as minute as the quality of image recording performed with a recording head having half of the interval P between the nozzles. Moreover, if ink K and ink RK are simultaneously ejected for image recording, image recording can be performed with a higher speed and a higher quality.

Figure 5:
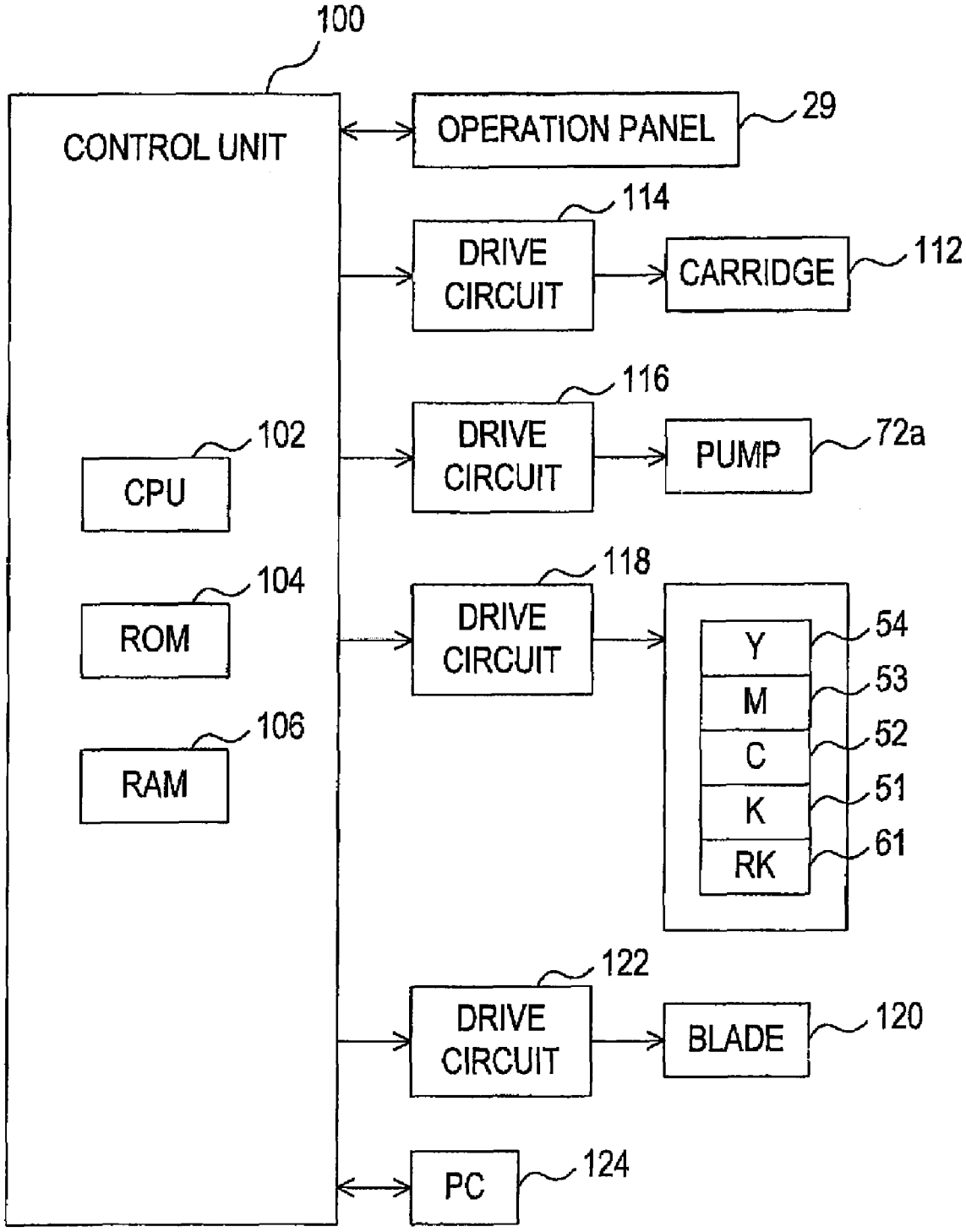
FIG. 5 is a block diagram showing a main part of an electric structure in the inkjet recording apparatus according to the first embodiment.

As shown in FIG. 5, the inkjet recording apparatus 1 includes a control unit 100, a carriage 112, a blade 120, and drive circuits 114, 116 and 118, and 122 in addition to the constituents shown in FIG. 2. The control unit 100 has a CPU 102, a ROM 104, and a RAM 106 which are conventionally known.

The carriage 112 is reciprocated in the y-axis direction upon receipt of a control signal from the control unit 100 via the drive circuit 114.

The pump 72*a* is driven upon receipt of a control signal from the control unit 100 via the drive circuit 116. As a result, the above-described ink suction from the nozzles of the recording heads, and collection of ink, discharged from the recording heads due to flushing, can be performed.

When a control signal is outputted from the control unit 100 via the drive circuit 118, ink is ejected from desired nozzles in the head R 61 and the respective heads V 51-54.

When a control signal is outputted from the control unit 100 via the drive circuit 122, the blade 120 is driven. Consequently, wiping of the nozzle surfaces of the recording heads is performed by the blade 120.

Additionally, the control unit 100 performs various processes based on a control signal inputted from an external device, such as the operation panel 29 or a personal computer (to be referred to as "PC") 124 connected to the control unit 100 via a specific interface.

[Effect]

The following effect can be achieved with the inkjet recording apparatus according to the first embodiment. Ink can be saved by recycling ink discharged from the respective recording heads during a maintenance operation and using the recycled-ink as ink RK. Additionally, image recording can be performed even when ink K runs out by providing a head R for ink RK, which is in an equivalent color to ink K, and using ink RK of the head R. Furthermore, the amount of ink that can be used for ink RK increases because ink RK is not only made of ink K, but also made of ink C, M, Y, K, and RK, collected and mixed together. Therefore, the frequency of replenishing ink K can be reduced.

In the present embodiment, inks C, M, Y, K, and RK are all collected, mixed together, and reused as ink RK for image recording.

Alternatively, ink RK can be made of at least inks C, M, and Y, which are discharged once, and used for image recording.

Specifically, the inkjet recording apparatus 1 may have a structure wherein ink discharged only from the heads V 52-54 for ink C, M, and Y, or ink discharged only from the heads V 51-54 for ink C, M, Y, and K are collected, mixed together, and reused as ink RK. This structure can be achieved by a configuration wherein the cap 71*a* receives ink discharged only from the heads V 52-54 for ink C, M, and Y in bulk, or ink discharged only from the heads V 51-54 for ink C, M, Y, and K in bulk, and the collected ink is reserved in the recycled-ink tank 41 through the collected-ink path 75.

Second Embodiment

Figure 6:
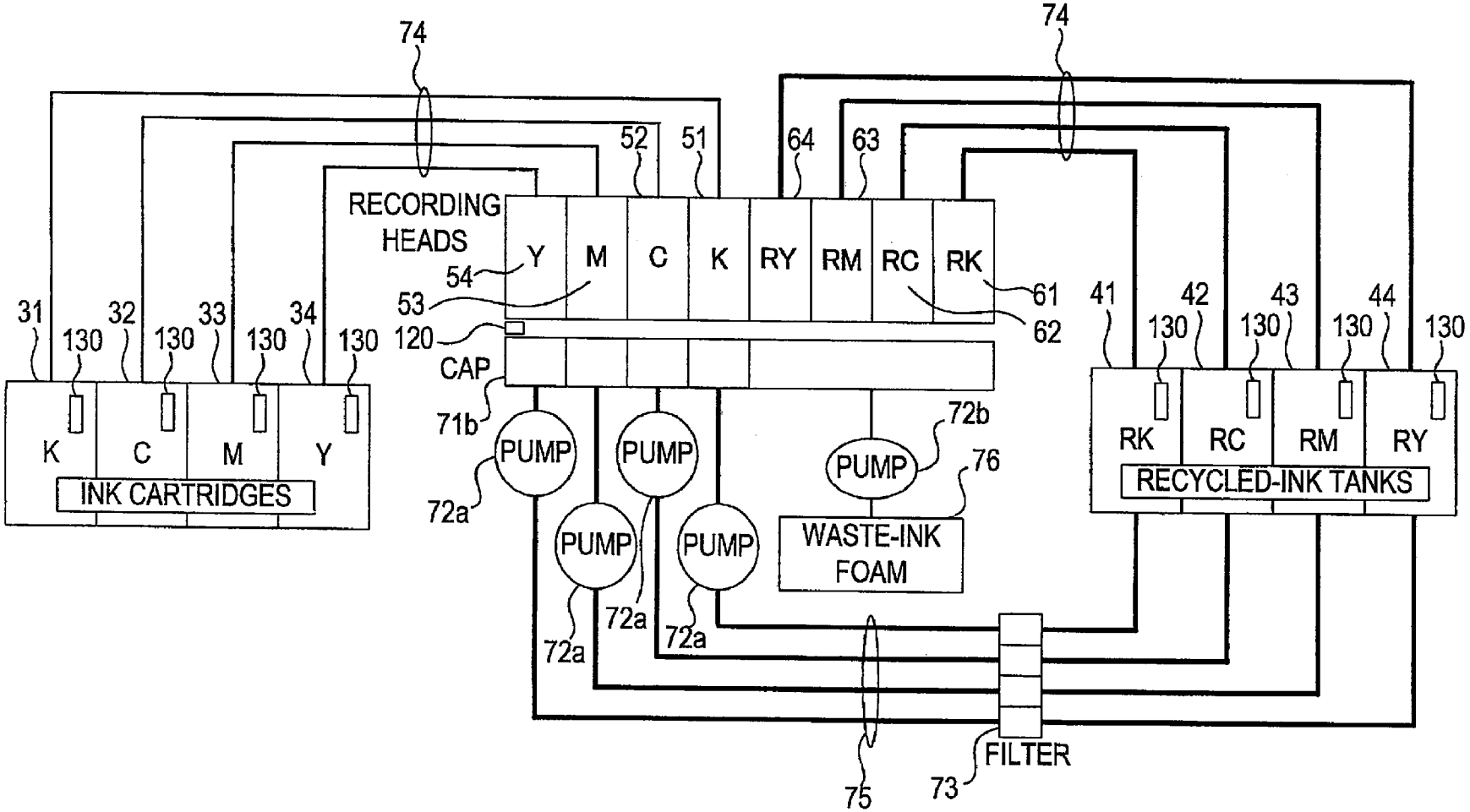
FIG. 6 is a block diagram, showing a schematic structure of a main part of an inkjet recording apparatus according to a second embodiment of the present invention.

In FIG. 6, which schematically shows the substantial structure of an inkjet recording apparatus 1 according to a second embodiment, the same reference numbers are given to the same components as in the first embodiment shown in FIG. 2.

As shown in FIG. 6, the inkjet recording apparatus 1 according to the second embodiment includes ink cartridges 31, 32, 33, and 34, and recycled-ink tanks 41, 42, 43 and 44. Each of the ink cartridges 31-34 stores one of unused-inks K, C, M, and Y, in the aforementioned ink reservoir unit. Each of the recycled-ink tanks 41-44 stores one of recycled-inks K, C, M, and Y (to be referred to as "RK", "RC", "RM", and "RY"). The inkjet recording apparatus 1 is furthermore provided with recording heads 51, 52, 53, and 54 for unused-ink (head V) respectively for ink K, C, M, and Y, and recording heads 61, 62, 63, and 64 for recycled-ink (heads R) respectively for ink RK, RC, RM, and RY, on a carriage in the aforementioned recording unit. The inkjet recording apparatus 1 is still furthermore provided with a cap 71*b*, pumps 72*a*, a pump 72*b*, a filter 73, collected-ink paths 75, and a waste-ink foam 76, in the aforementioned maintenance unit. Additionally, the inkjet recording apparatus 1 is provided with ink supply tubes 74. It is to be noted that all of the unused-inks K, C, M, and Y, are dye ink.

The cap 71*b* is configured so as to separately receive ink discharged from the respective heads V 51-54, and to receive ink discharged from heads R 61-64 together in bulk.

Ink, discharged into the cap 71*b* from the respective heads V 51-54 during a maintenance operation, is collected separately by the pumps 72*a*. Collected ink flows in the respective collected-ink paths 75, is filtered through the filter 73, and stored in the respective recycled-ink tanks 41-44.

On the other hand, ink discharged into the cap 71*b* from the heads R 61-64 during a maintenance operation is collected together by the pump 72*b*. The collected ink is discarded into the waste-ink foam 76 and absorbed therein.

The recycled-ink tanks 41-44 and the ink cartridges 31-34 in the ink reservoir unit are respectively communicated with the heads R 61-64 and the heads V 51-54, on the carriage in the recording unit, via the ink supply tubes 74. Recycled-ink, stored in the recycled-ink tanks 41-44, and unused-ink, stored in the ink cartridges 31-34, are respectively supplied to the corresponding recording heads through the ink supply tubes 74.

Figure 7:
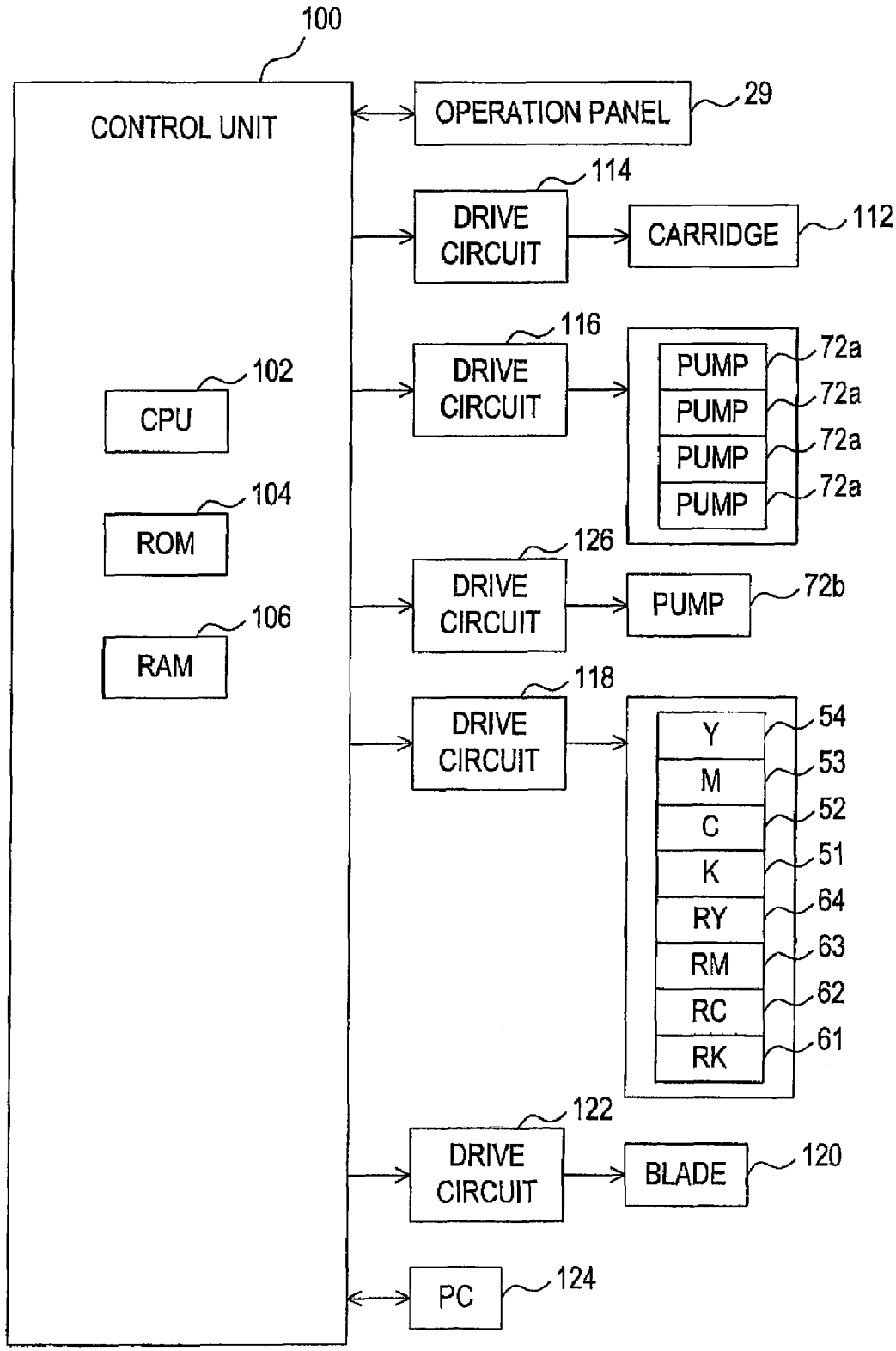
FIG. 7 is a block diagram showing a main part of an electric structure in the inkjet recording apparatus according to the second embodiment.

As shown in FIG. 7, the inkjet recording apparatus 1 includes a control unit 100, a carriage 112, a blade 120, and drive circuits 114, 116, 118, 122, and 126 in addition to the constituents shown in FIG. 6. The control unit 100 has a CPU 102, a ROM 104, and a RAM 106 which are conventionally known.

The carriage 112 is reciprocated in the y-axis direction upon receipt of a control signal from the control unit 100 via the drive circuit 114.

Each of the pumps 72*a* is driven upon receipt of a control signal from the control unit 100 via the drive circuit 116. The pump 72*b* is driven upon receipt of a control signal from the control unit 100 via the drive circuit 126. As a result, the above-described collection of ink, discharged from the recording heads, can be performed.

When a control signal is outputted from the control unit 100 via the drive circuit 118, ink is ejected from desired nozzles in the respective heads R 61-64 and the respective heads V 51-54.

When a control signal is outputted from the control unit 100 via the drive circuit 122, the blade 120 is driven. Consequently, wiping of the nozzle surfaces of the recording heads is performed by the blade 120.

Additionally, the control unit 100 performs various processes based on a control signal inputted from an external device, such as the operation panel 29 or the PC 124 connected to the control unit 100 via a specific interface.

[Effect]

The following effect can be achieved with the inkjet recording apparatus according to the second embodiment. In the present embodiment, ink C, M, Y, and K, discharged from the ink cartridges 31-34 during a maintenance operation, is recycled as ink in the original colors and reused in the respective heads R 61-64. Therefore, each color of ink can be effectively saved in a case wherein not only ink K, but also ink C, M, and Y are frequently used, such as for color image recording.

In the present embodiment, only unused-ink, discharged from the respective heads V 51-54, is recycled. Recycled-ink, discharged from the respective heads R 61-64, is discarded. Thus, recycled-ink does not repeatedly go through a cycle of "being discharged and collected". That is, recycled-ink, supplied to the respective heads R 61-64, is limited only to unused-ink that is discharged from the respective heads V 51-54 and collected. As a result, an excessive increase in the viscosity of recycled-ink due to desiccation associated with ink-discharge can be inhibited. The quality of image recording with recycled-ink can be well maintained.

In the present embodiment, inks of respective colors discharged from the heads V 51-54 are individually collected, and respectively ejected from the heads R 61-64 as recycled-inks of respective colors.

In addition to the inks of respective colors discharged from the heads V 51-54, inks of respective colors discharged from the heads R 61-64 can be also individually collected, and respectively ejected from the heads R 61-64 as recycled-inks of respective colors.

Specifically, the cap 71*b* may be configured so as to individually receive each of inks discharged from respective heads V 51-54, and to individually receive each of inks discharged from respective heads R 61-64.

In this case, a collected-ink path, having the same structure as the collected-ink path 75, is provided for each of inks of respective colors discharged from the respective heads R 61-64. Inks of respective colors, discharged from the respective heads R 61-64 due to a maintenance operation, are individually reserved in the corresponding recycled-ink tanks 41-44 through the collected-ink paths (and via pumps, having the same structure as the pumps 72*a*, and the filter 73 which are both provided on the paths).

According to this configuration, inks of respective colors, which are discharged during a maintenance operation, can be reused. Therefore, inks of respective colors can be more effectively saved.

Third Embodiment

Figure 8:
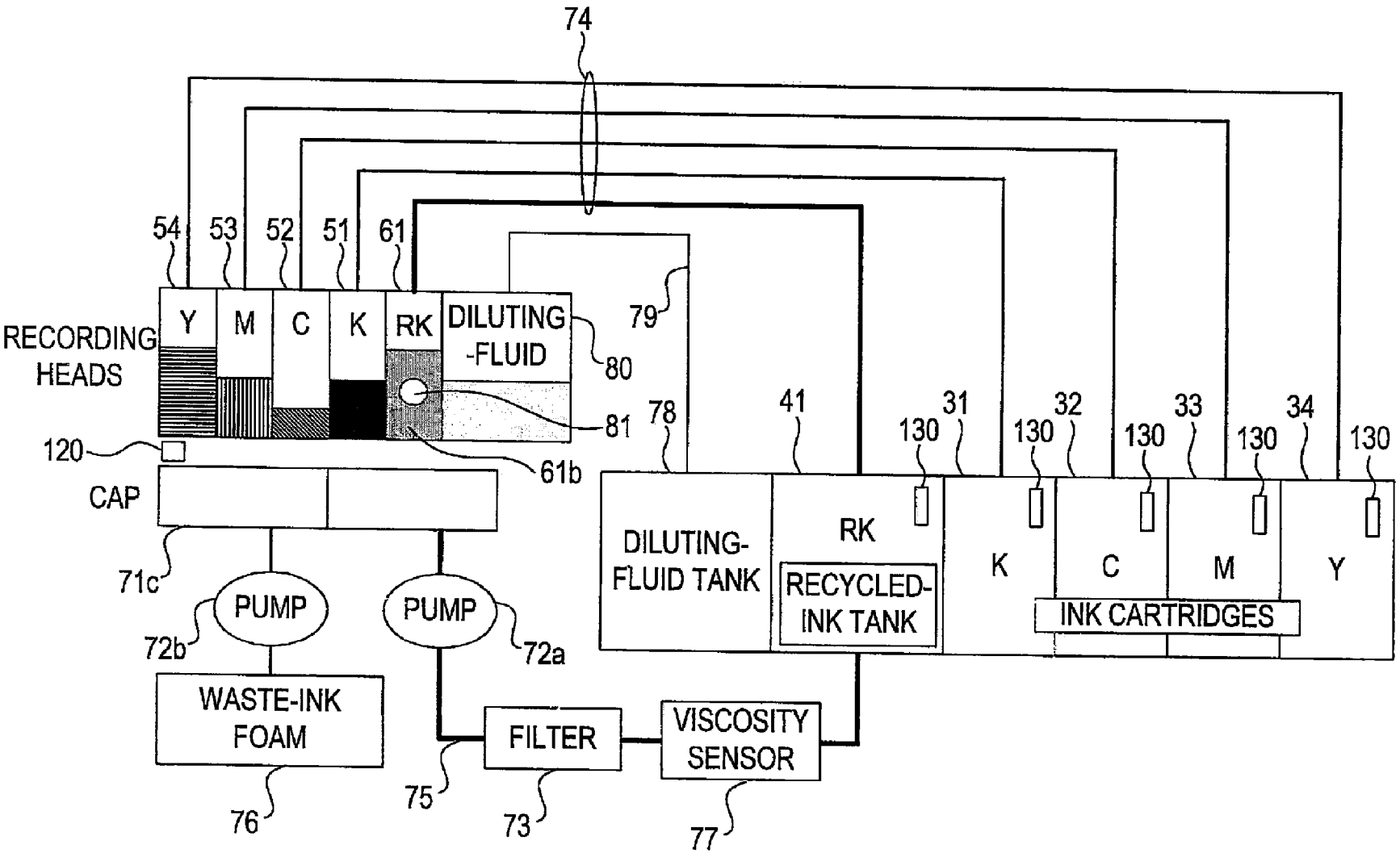
FIG. 8 is a block diagram showing a schematic structure of a main part of an inkjet recording apparatus according to a third embodiment of the present invention.

In FIG. 8, which schematically shows the substantial structure of an inkjet recording apparatus 1 according to a third embodiment, the same reference numbers are given to the same components as in the first embodiment shown in FIG. 2 or in the second embodiment shown in FIG. 6.

As shown in FIG. 8, the inkjet recording apparatus 1 according to the third embodiment includes ink cartridges 31, 32, 33, and 34, a recycled-ink tank 41, and a diluting-fluid tank 78. Each of the ink cartridges 31-34 stores one of the unused-inks K, C, M, and Y, in the aforementioned ink reservoir unit. The recycled-ink tank 41 stores ink RK. The diluting-fluid tank 78 stores diluting-fluid, which is added into the ink so as to adjust the viscosity of the ink. The inkjet recording apparatus 1 is furthermore provided with heads V 51, 52, 53, and 54, a head R 61, and a diluting-fluid ejection head 80, on a carriage in the aforementioned recording unit. Each of the heads V 51-54 is used for one of the inks K, C, M, and Y. The head R 61 is used for ink RK. The diluting-fluid ejection head 80 is disposed adjacent to the head R 61. The inkjet recording apparatus 1 is still furthermore provided with a cap 71*c*, pumps 72*a* and 72*b*, a filter 73, a collected-ink path 75, a waste-ink foam 76, and a viscosity sensor 77, in the aforementioned maintenance unit. Additionally, the inkjet recording apparatus 1 is provided with ink supply tubes 74 and a diluting-fluid supply tube 79. A stirring ball 81 for stirring recycled-ink is stored in a sub-tank 61*b* incorporated in the head R 61. It is to be noted that all of the unused-inks K, C, M, and Y, are dye ink.

The cap 71*c* is configured so as to receive ink discharged from the head V 51 for ink K together with the head R 61 for ink RK, and to receive ink discharged from the heads V 52-54 for ink C, M, and Y together in bulk separately from the other.

When a maintenance operation is performed, ink is discharged from the head V 51 for ink K and the head R 61 into the cap 71*c*. Diluting-fluid is ejected from the diluting-fluid ejection head 80, which is adjacent to the head R 61, into the cap 71*c* so as to be added to the discharged ink. The diluting-fluid ejection head 80 ejects a predetermined amount of diluting-fluid (when, for example, the viscosity of the recycled-ink is equal to or higher than a predetermined value) depending on the viscosity of the recycled-ink detected by the viscosity sensor 77.

The ink diluted with diluting-fluid is collected by the pump 72*a*. The collected ink flows in the collected-ink path 75, and is filtered through the filter 73. The collected ink passes the viscosity sensor 77 and is stored in the recycled-ink tank 41 for ink RK. Instead of disposing the viscosity sensor 77 on the collected-ink path 75, the viscosity sensor 77 can be disposed at any arbitrary position where recycled-ink passes, such as on the ink supply tube 74 for ink RK or inside of the sub-tank 61*b* incorporated into the head R 61.

In the present embodiment, the diluting-fluid ejection head 80 is disposed adjacent to the head R 61. However, the diluting-fluid ejection head 80 may be disposed at one position among inside of any of the heads V 51-54, inside of the head R 61, adjacent to any of the heads 51-54, or adjacent to the head R 61 and any of the heads V 51-54.

On the other hand, ink discharged into the cap 71*c* from the heads V 52-54 for ink C, M, and Y, during a maintenance operation is all collected together by the pump 72*b*, and discarded into the waste-ink foam 76.

The diluting-fluid tank 78 is communicated with the diluting-fluid ejection head 80 via the diluting-fluid supply tube 79. Diluting-fluid, stored in the diluting-fluid tank 78, is supplied to the diluting-fluid ejection head 80 through the diluting-fluid supply tube 79.

The stirring ball 81, stored within the sub-tank 61*b* in the head R 61, is urged as the carriage, carrying the recording heads 51-54 and 61 and the like, reciprocates for image recording and the stirring ball 81 moves in the sub-tank 61*b*. By the movement of the stirring ball 81 in the sub-tank 61*b*, recycled-ink stored in the sub-tank 61*b* can be stirred and well mixed with diluting-fluid that is added to the ink. A metallic or resinous spherical body can be used for the stirring ball 81.

Figure 9A:
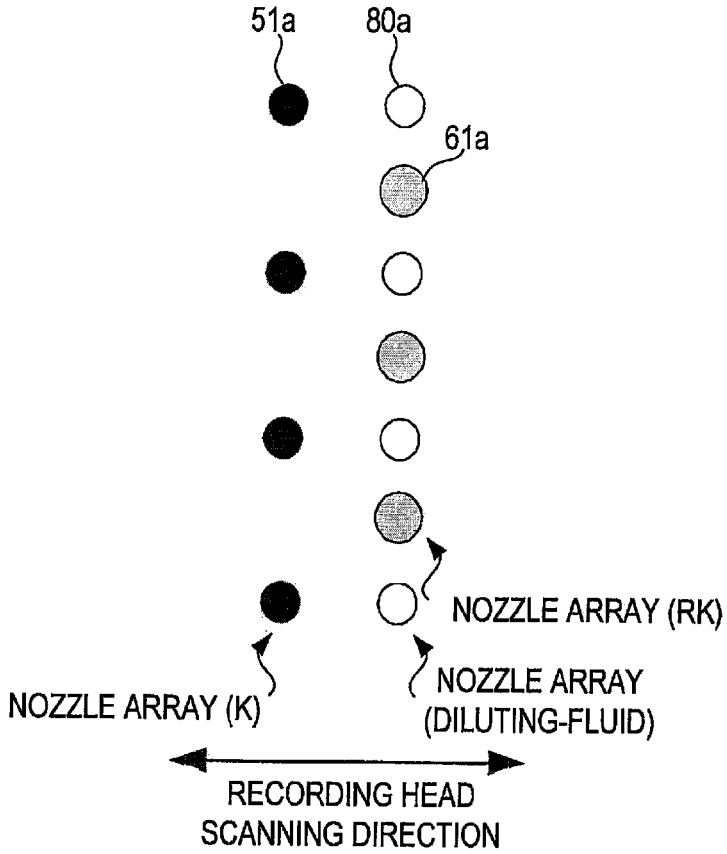
FIGS. 9A and 9B are schematic views showing examples of the disposition of diluting-fluid nozzles of a diluting-fluid ejection head.
Figure 9B:
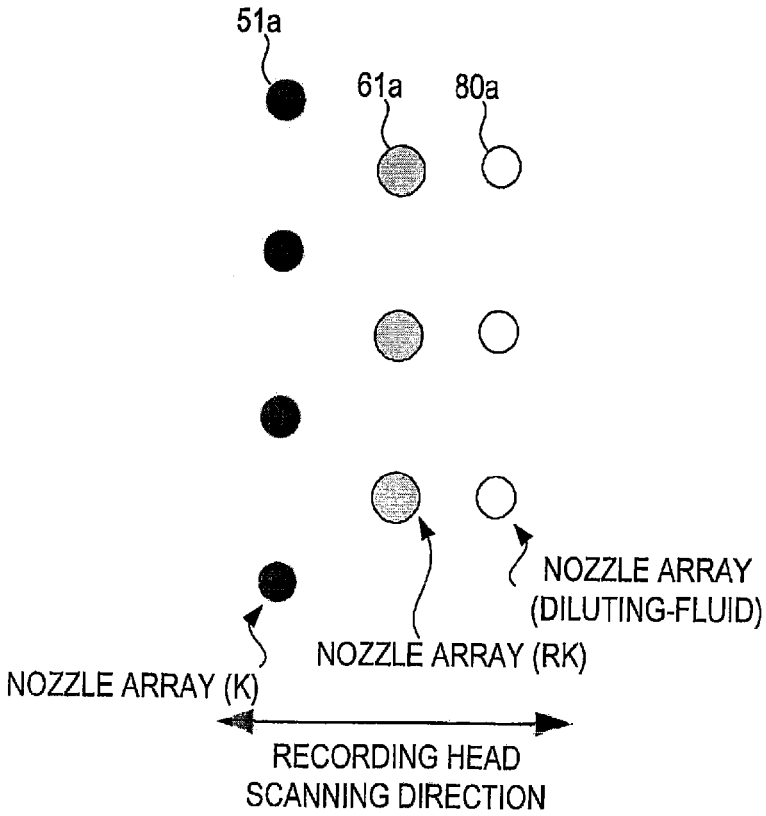

In FIG. 9A, each diluting-fluid nozzle 80*a* is disposed between two nozzles 61*a* in the nozzle array for ink RK. In FIG. 9B, the nozzle array of the diluting-fluid nozzles 80*a* is disposed adjacent to the nozzle array of the nozzles 61*a* for RK ink. In both disposition examples shown in FIGS. 9A and 9B, diluting-fluid is ejected in close vicinity of the nozzles 61*a* of the head R 61 from which ink RK is discharged during a maintenance operation. Therefore, discharged ink and ejected diluting-fluid can be quickly mixed together.

Figure 10:
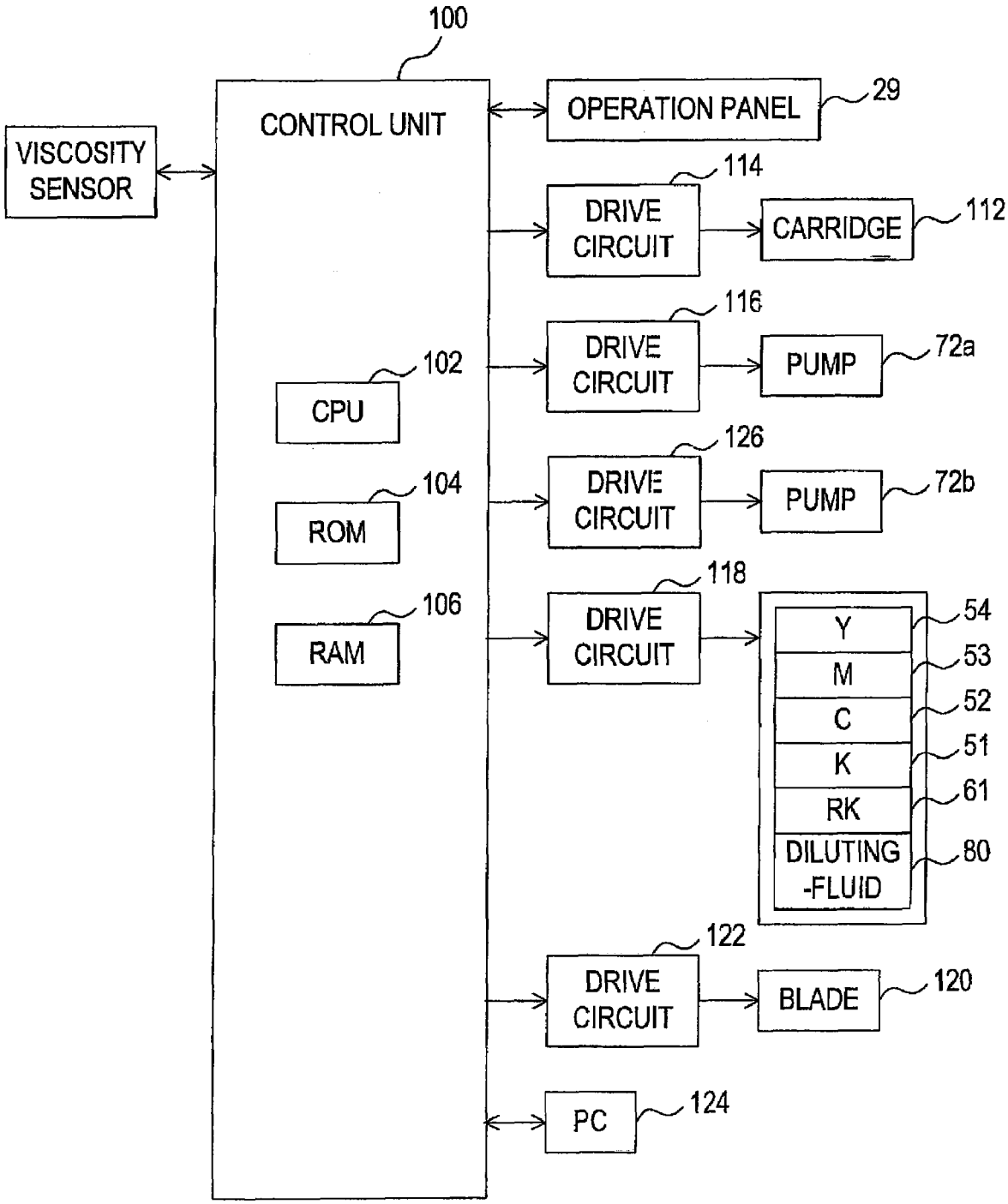
FIG. 10 is a block diagram showing a main part of an electric structure in the inkjet recording apparatus according to the third embodiment.

As shown in FIG. 10, the inkjet recording apparatus 1 includes a control unit 100, a carriage 112, a blade 120, and drive circuits 114, 116 and 118, 122, and 126 in addition to the constituents shown in FIG. 8. The control unit 100 has a CPU 102, a ROM 104, and a RAM 106 which are conventionally known.

The carriage 112 is reciprocated in the y-axis direction upon receipt of a control signal from the control unit 100 via the drive circuit 114.

The pump 72*a* is driven upon receipt of a control signal from the control unit 100 via the drive circuit 116. The pump 72*b* is driven upon receipt of a control signal from the control unit 100 via the drive circuit 126. As a result, the above-described collection of ink, discharged from the recording heads, can be performed.

When a control signal is outputted from the control unit 100 via the drive circuit 118, ink is ejected from desired nozzles in the head R 61 and the respective heads V 51-54. Depending on the viscosity of recycled-ink detected by the viscosity sensor 77, a control signal is outputted from the control unit 100 to the diluting-fluid ejection head 80 via the drive circuit 118. Consequently, a predetermined amount of diluting-fluid is ejected from the diluting-fluid ejection head 80.

When a control signal is outputted from the control unit 100 via the drive circuit 122, the blade 120 is driven. Consequently, wiping of the nozzle surfaces of the recording heads is performed by the blade 120.

Additionally, the control unit 100 performs various processes based on a control signal inputted from an external device, such as the operation panel 29 or the PC 124 connected to the control unit 100 via a specific interface.

[Effect]

The following effect can be achieved with the inkjet recording apparatus 1 according to the third embodiment. The viscosity of recycled-ink can be adjusted by adding diluting-fluid from the diluting-fluid ejection head 80, if the viscosity of recycled-ink detected by the viscosity sensor 77 is equal to or higher than a predetermined value. As a result, deterioration of the image quality, which can be caused by a significant increase in the viscosity of recycled-ink, can be inhibited. In other words, since the viscosity of recycled-ink can be adjustable, recycled-ink discharged from the head R 61 during a maintenance operation can be reused repeatedly without the viscosity of the recycled-ink being increased. Therefore, ink can be saved more effectively.

Additionally, since the stirring ball 81 is moved within the sub-tank 61*b* of the head R 61 corresponding to the reciprocate movement of the carriage for image recording, recycled-ink, which is stored in the sub-tank 61*b* and in which diluting-fluid is added, is stirred. Therefore, the viscosity of the recycled-ink can be uniform.

Fourth Embodiment

Figure 11:
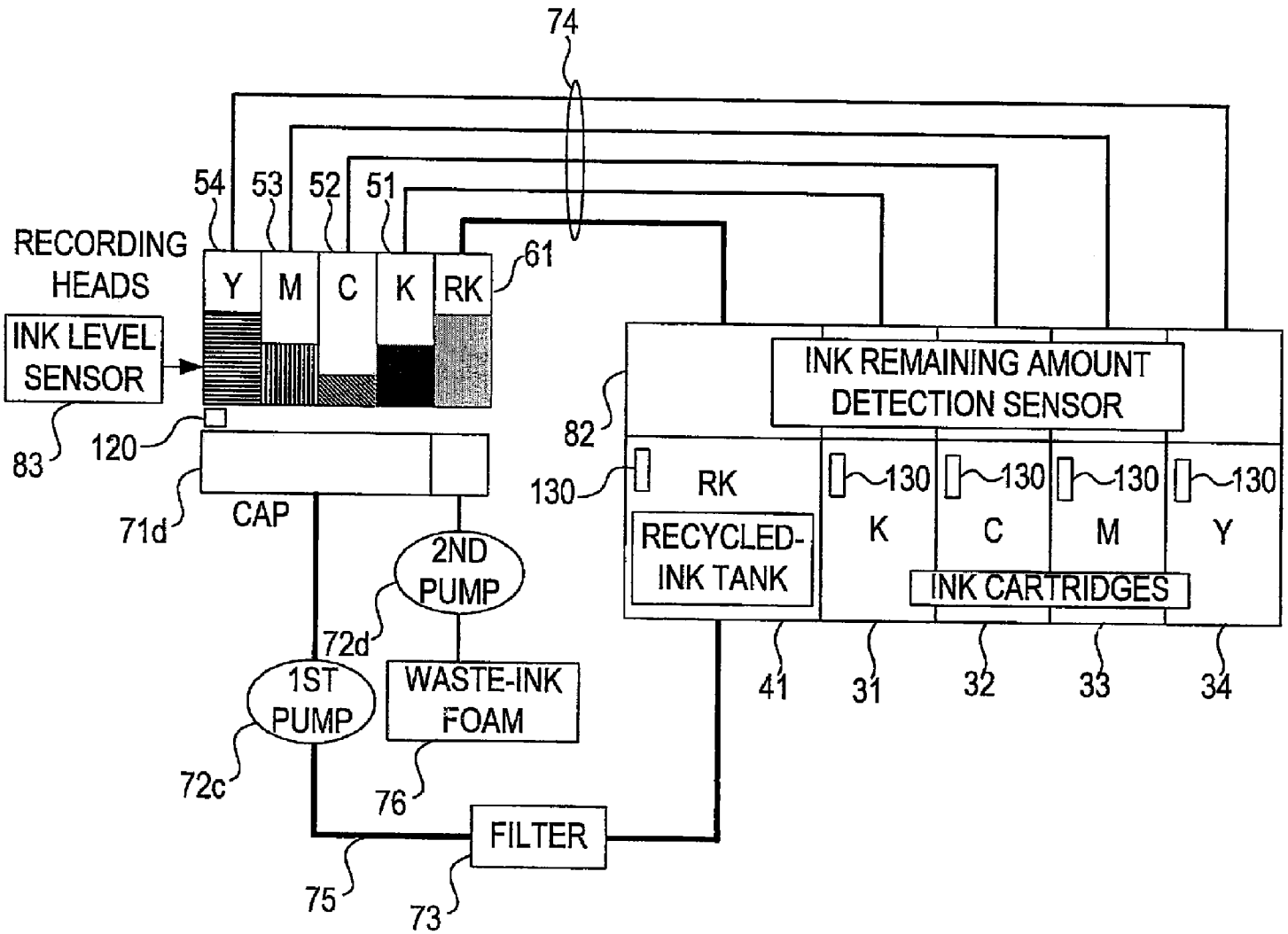
FIG. 11 is a block diagram showing a schematic structure of a main part of an inkjet recording apparatus according to a fourth embodiment of the present invention.

In FIG. 11, which schematically shows the substantial structure of an inkjet recording apparatus 1 according to a fourth embodiment, the same reference numbers are given to the same components as in the first embodiment shown in FIG. 2, in the second embodiment shown in FIG. 6, or in the third embodiment shown in FIG. 8.

As shown in FIG. 11, the inkjet recording apparatus 1 according to the fourth embodiment includes ink cartridges 31, 32, 33, and 34, and a recycled-ink tank 41. Each of the ink cartridges 31-34 stores one of the unused-inks K, C, M, and Y, in the aforementioned ink reservoir unit. The recycled-ink tank 41 stores ink RK. The inkjet recording apparatus 1 is furthermore provided with heads V 51, 52, 53, and 54, and a head R 61, on a carriage in the aforementioned recording unit. Each of the heads V 51-54 are used for one of the inks K, C, M, and Y. The head R 61 is used for ink RK. The inkjet recording apparatus 1 is still furthermore provided with a cap 71*d*, a first pump 72*c*, a second pump 72*d*, a filter 73, a collected-ink path 75, and a waste-ink foam 76, in the aforementioned maintenance unit. Additionally, the inkjet recording apparatus 1 is provided with ink supply tubes 74, an ink remaining amount detection sensor 82, and an ink level detection sensor 83. The ink remaining amount detection sensor 82 detects the remaining amount of each ink stored respectively in ink cartridges 31-34 and the recycled-ink tank 41. The ink level detection sensor 83 detects whether or not ink remains in each one of the sub-tanks incorporated in respective recording heads 51-54 and 61. It is to be noted that all of the unused-inks K, C, M, and Y, are dye ink.

The ink remaining amount detection sensor 82 is constituted with a known optical sensor or the like. The ink level detection sensor 83 optically detects the levels of ink in each sub-tank incorporated in each recording head and detects whether or not ink remains in each sub-tank.

The cap 71*d* is configured so as to receive ink discharged from the heads V 51-54 together in bulk, and to receive ink discharged from the head R 61 separately from the others.

Figure 12:
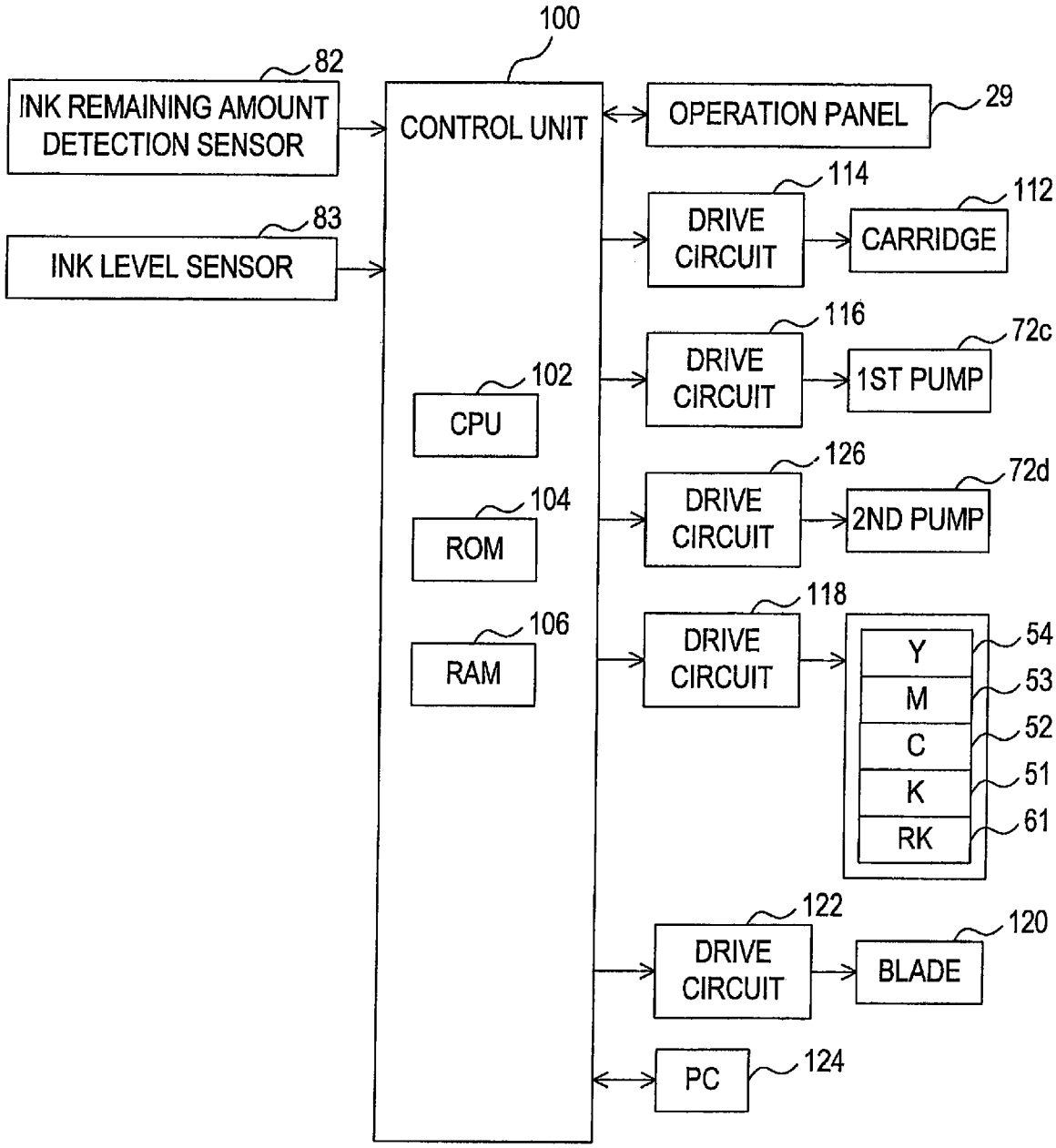
FIG. 12 is a block diagram showing a main part of an electric structure in the inkjet recording apparatus according to the fourth embodiment.

As shown in FIG. 12, the inkjet recording apparatus 1 includes a control unit 100, a carriage 112, a blade 120, and drive circuits 114, 116, 118, 122, and 126 in addition to the constituents shown in FIG. 11. The control unit 100 has a CPU 102, a ROM 104, and a RAM 106 which are conventionally known.

The carriage 112 is reciprocated in the y-axis direction upon receipt of a control signal from the control unit 100 via the drive circuit 114.

A control signal is outputted from the control unit 100 to the first pump 72*c* via the drive circuit 116 corresponding to information detected by the ink remaining amount detection sensor 82 and information detected by the ink level detection sensor 83. The first pump 72*c* is driven upon receipt of the control signal. Moreover, a control signal is outputted from the control unit 100 to the second pump 72*d* via the drive circuit 126 corresponding to information detected by the ink remaining amount detection sensor 82 and information detected by the ink level detection sensor 83. The second pump 72*d* is driven upon receipt of the control signal. As a result, the above-described collection of ink, discharged from the recording head, can be performed in the present embodiment in a similar manner to the other embodiments.

A control signal is outputted from the control unit 100 to the head R 61 and the respective heads V 51-54 corresponding to information detected by the ink remaining amount detection sensor 82 and information detected by the ink level detection sensor 83. Ink is ejected from desired nozzles in the head R 61 and the respective heads V 51-54 in response to the control signal.

When a control signal is outputted from the control unit 100 via the drive circuit 122, the blade 120 is driven. Consequently, wiping of the nozzle surfaces of the recording heads is performed by the blade 120.

Additionally, the control unit 100 performs various processes based on a control signal inputted from an external device, such as the operation panel 29 or the PC 124 connected to the control unit 100 via a specific interface.

It is to be noted that the sequence of collection, reuse and disposal of ink is performed the same as in the other embodiments described above, and that the description thereof is not repeated here.

In the inkjet recording apparatus 1 according to the present embodiment, an excessive ink disposal process, a recording mode selection process, a process for a recycled-ink priority recording mode, and a process for an unused-ink priority recording mode can be performed. These processes can be performed in accordance with a determination made by the control unit 100 using the ink remaining amount detection sensor 82 and the ink level detection sensor 83, and a control signal outputted from the control unit 100 based on the determination. Each process will be explained below with reference to the flowcharts shown in FIGS. 13-16.

[Excessive Ink Disposal Process]

Figure 13:
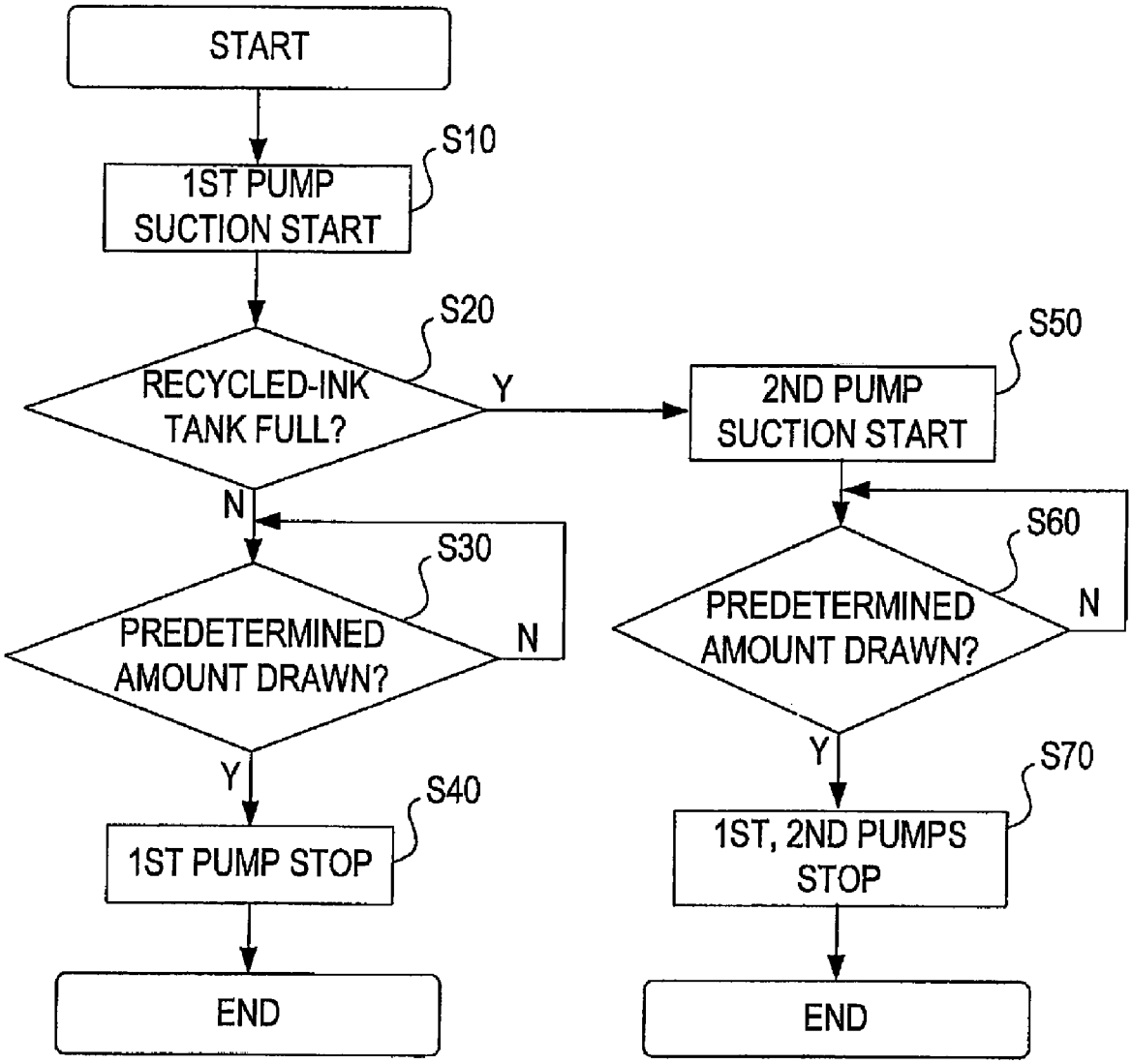
FIG. 13 is a flowchart explaining an excessive ink disposal process.

Referring to FIG. 13, the excessive ink disposal process is performed based on control by a control unit (not shown) of the inkjet recording apparatus 1. In this process, excessive recycled-ink is discarded when the amount of collected recycled-ink becomes more than the consumption amount, in order to inhibit the recycled-ink tank 41 from being full, which may end up with an overflow of recycled-ink.

In Step 10 (to be simply denoted as S10, other steps will also be denoted in the same manner), corresponding to an initiation of a maintenance operation in the heads V 51-54, ink suction is initiated by the first pump 72*c*. In S20 it is determined whether or not the recycled-ink tank 41 is full according to information regarding the ink remaining amount in the recycled-ink tank 41, detected by the ink remaining amount detection sensor 82. If it is determined that the recycled-ink tank 41 is not full (S20:N), the process proceeds to S30. In S30 it is determined whether or not the ink suction amount by the first pump 72*c* has reached a predetermined amount. The predetermined amount mentioned here corresponds to the amount of ink to be discharged from the recording heads 51-54 as a result of a maintenance operation.

The determination whether or not the amount of ink drawn by the first pump 72*c* has reached the predetermined amount may be made based on specific information described below. That is, for example, this determination may be made based on at least one of information detected by the ink remaining amount detection sensor 82 regarding a change in the ink remaining amount in the ink cartridges 31-34, and information detected by the ink level detection sensor 83 regarding a change in the positions of surfaces of ink reserved in the sub-tanks in the heads V 51-54. This determination may alternatively be made based on a result of a determination made by the control unit 100 regarding whether or not the driving duration time of the first pump 72*c* has reached a predetermined length.

If it is determined that the ink suction amount by the first pump 72*c* has not reached the predetermined amount (S30:N), drawing of ink by the first pump 72*c* is continued. If it is determined that the ink drawing amount by the first pump 72*c* has reached the predetermined amount (S30:Y), that is, when the collection of ink discharged from the recording heads in a maintenance operation is completed, in S40 the maintenance operation is completed as the first pump 72*c* is stopped. Then, the excess ink disposal process is finished. Ink collected by the first pump 72*c* flows in the collected-ink path 75, passes through the filter 73, and is stored in the recycled-ink tank 41.

On the other hand, in S20 if it is determined that the recycled-ink tank 41 is full (S20:Y), ink suction by the second pump 72*d* is initiated in S50. As a result of ink suction by the second pump 72*d*, ink is forcibly discharged from the head R 61 so as to collect excessive ink in the recycled-ink tank 41. Subsequently, in S60 it is determined whether or not the ink suction amounts by the first and the second pumps 72*c* and 72*d* respectively have both reached predetermined amounts. It is to be noted that the predetermined suction amount by the first pump 72*c* corresponds to the amount of ink to be discharged from the recording heads 51-54 due to a maintenance operation, and the predetermined suction amount by the second pump 72*d* corresponds to, or more than, the amount of ink to be discharged from the recording heads 51-54 due to a maintenance operation.

The determination whether or not the amount of ink drawn by the first pump 72*c* has reached the predetermined amount may be made based on the specific information described above with regard to S30.

Additionally, the determination whether or not the amount of ink drawn by the second pump 72*d* has reached the predetermined amount may be made based on specific information described below. That is, for example, this determination may be made based on at least one of information detected, by the ink remaining amount detection sensor 82 regarding a change in the ink remaining amount in the recycled-ink tank 41, and information detected by the ink level detection sensor 83 regarding a change in the position of the surface of the ink reserved in the sub-tank in the head R 61. Alternatively, this determination may be made based on a result of a determination made by the control unit 100 regarding whether or not the driving duration time of the second pump 72*d* has reached a predetermined length.

In S60 if it is respectively determined that the ink suction amounts by the first and the second pumps 72*c* and 72*d* have not reached the predetermined amounts (S60:N), ink suction is continued. When it is determined that the ink suction amounts by the first and the second pumps 72*c* and 72*d* respectively have reached the predetermined amounts (S60:Y), that is, when the collection of ink discharged from the recording heads 51-54 and excessive ink in the recycled-ink tank 41 is completed, the process proceeds to S70. In S70 the first and the second pumps 72*c* and 72*d* are stopped. As a result, the maintenance operation is completed, and the excessive ink disposal process is finished.

Ink collected by the second pump 72*d* from the recycled-ink tank 41 is discarded into the waste-ink foam 76. On the other hand, ink collected by the first pump 72*c* flows in the collected-ink path 75, passes through the filter 73, and is stored in the recycled-ink tank 41.

In the excessive ink disposal process, when the recycled-ink tank 41 is full, ink in the recycled-ink tank 41 is collected for the amount equivalent to the amount of ink to be collected in a maintenance operation or more. As a result, overflow of recycled-ink can be inhibited.

[Recording Mode Selection Process]

Figure 14:
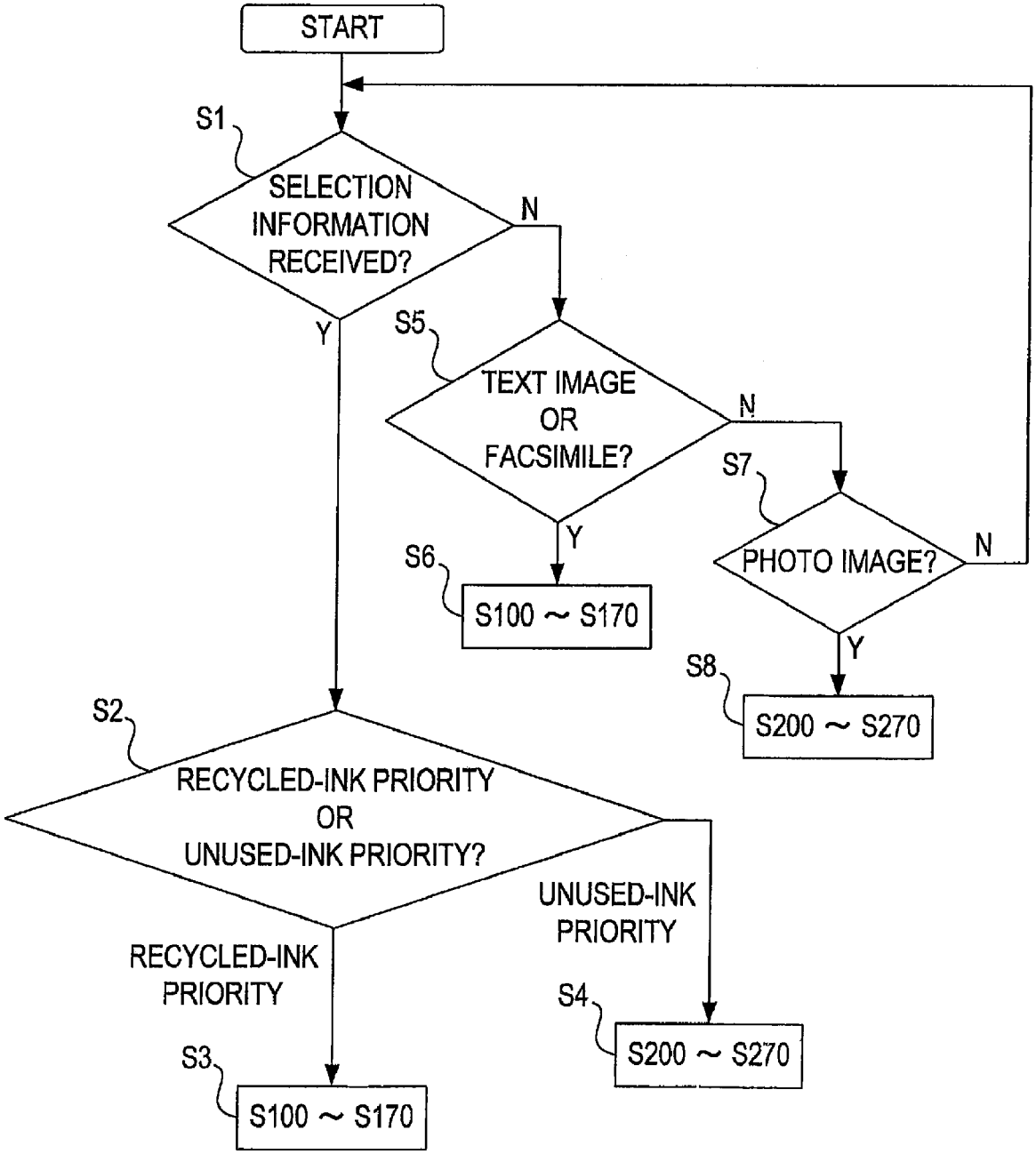
FIG. 14 is a flowchart explaining a recording mode selection process.

The purpose of this process, shown in the flowchart in FIG. 14, is to select one of the recycled-ink priority recording mode and the unused-ink priority recording mode for image recording wherein ink is ejected from the head R 61 or the respective heads V 51-54.

In the recycled-ink priority recording mode, recycled-ink is used in preference to unused-ink. This recording mode is to perform image recording wherein ink saving is emphasized more than image quality. In the unused-ink priority recording mode, unused-ink is used in preference to recycled-ink. This recording mode is to perform image recording wherein image quality is emphasized more than ink saving.

As shown in FIG. 14, in S1 it is determined whether or not selection information to select the recycled-ink priority recording mode or to select the unused-ink priority recording mode is inputted into the control unit 100 by a user with an external device, such as key switches in the operation panel 29, disposed on the top surface of the inkjet recording apparatus 1, or the PC 124.

If it is determined that the selection information is inputted (S1:Y), in S2 it is determined whether the inputted selection information is to select the recycled-ink priority recording mode or to select the unused-ink priority recording mode.

Figure 15:
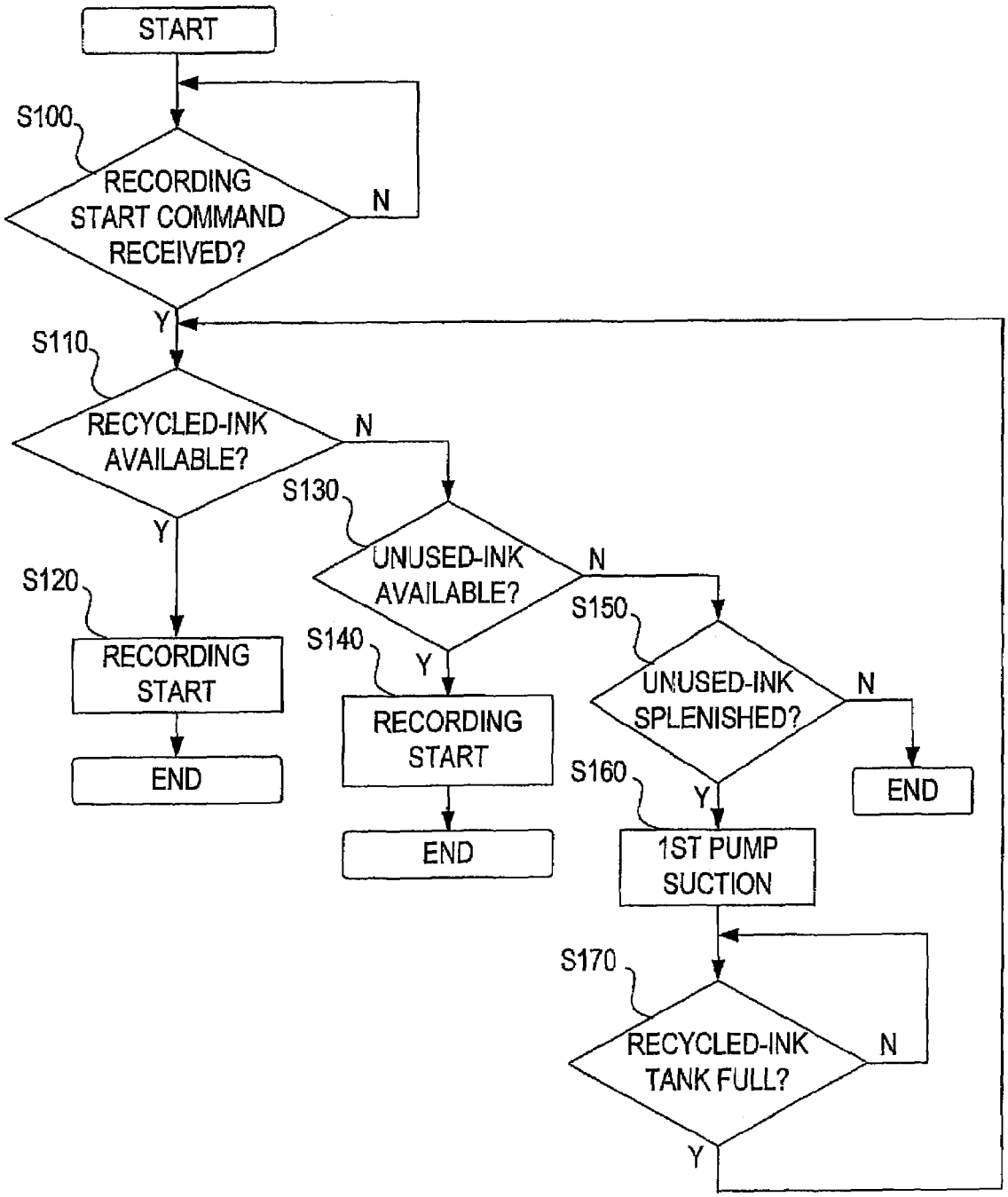
FIG. 15 is a flowchart explaining a process for a recycled-ink priority recording mode.

In S2 if it is determined that the inputted selection information is to select the recycled-ink priority recording mode, the process for recycled-ink priority recording mode (S100-S170) shown in FIG. 15 is performed (S3).

Figure 16:
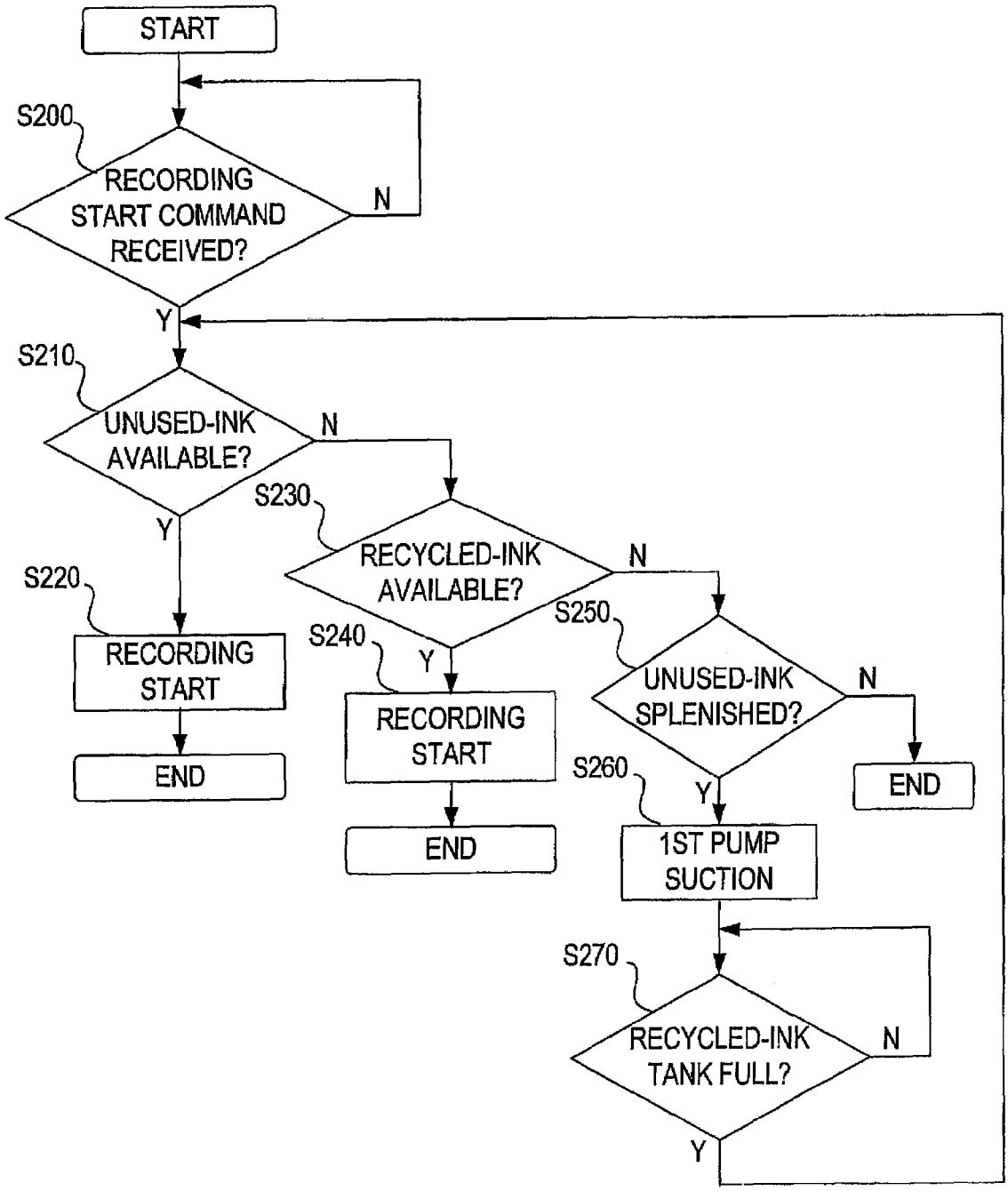
FIG. 16 is a flowchart explaining a process for an unused-ink priority recording mode.

In S2 if it is determined that the inputted information is to select the unused-ink priority recording mode, the process for unused-ink priority recording mode (S200-S270) shown in FIG. 16 is performed (S4).

On the other hand, in S1 if it is determined that the selection information is not inputted (S1:N), the process proceeds to S5. In S5 it is determined whether or not a command is received from an external device, such as the PC 124, so as to operate the inkjet recording apparatus 1 as a printer for initiating text-image recording, or so as to operate the inkjet recording apparatus 1 as a facsimile for initiating image recording. If an affirmative determination is made (S5:Y), the process for the recycled-ink priority recording mode (S100-S170) shown in FIG. 15 is performed (S6). If a denial determination is made (S5:N), the process proceeds to S7.

In S7 it is determined whether or not a command is received from the external device, such as the PC 124, so as to operate the inkjet recording apparatus 1 as a printer for initiating photo-image recording. If an affirmative determination is made (S7:Y), the process for unused-ink priority recording mode (S200-S270) shown in FIG. 16 is performed (S8). If a denial determination is made (S7:N), the process goes back to S1.

[Process for Recycled-Ink Priority Recording Mode]

As shown in FIG. 10, in S100, it is determined whether or not a command to initiate image recording is received by, for example, receiving image data. If it is determined that a command to initiate image recording is not determined to have been received (S100:N), this step is repeated.

When it is determined that a command to initiate image recording is received (S100:Y), the process proceeds to S110. In S110 it is determined whether or not recycled-ink (RK) remains, based on information regarding the ink remaining amount in the recycled-ink tank 41, detected by the ink remaining amount detection sensor 82, and information regarding the ink level in the sub-tank in the head R 61, detected by the ink level detection sensor 83. When it is determined that recycled-ink (RK) remains (S110:Y), in S120 image recording is initiated with the head R 61 wherein recycled-ink (RK) is used.

If it is determined that recycled-ink (RK) does not remain (S110:N), the process proceeds to S130. In S130 it is determined whether or not unused-ink (K) remains, based on information regarding the ink remaining amount in the ink cartridge 31, detected by the ink remaining amount detection sensor 82, and information regarding the ink level in the sub-tank in the head V 51, detected by the ink level detection sensor 83. When it is determined that unused-ink (K) exists (S130:Y), in S140 image recording is initiated with the head V 51 wherein unused-ink K is used.

If it is determined that unused-ink (K) does not remain (S130:N), the process proceeds to S150. In S150 it is determined whether or not the ink cartridge 31 has been replaced and the ink has been replenished.

The determination in S150 may be made based on specific information described below. That is, for example, this determination may be made based on at least one of information detected by the ink remaining amount detection sensor 82 regarding a change in the ink remaining amount inside of the ink cartridge 31, and information detected by the ink level detection sensor 83 regarding a change in the position of the surface of the ink reserved in the sub-tank inside of the head V 51.

When it is determined that the ink cartridge 31 has been replaced and the ink has been replenished (S150:Y), in S160 ink is drawn by the first pump 72*c* respectively from the heads V 51-54. The ink drawn by the first pump 72*c* is supplied to the recycled-ink tank 41.

Subsequently, in S170 it is determined whether or not the recycled-ink tank 41 has become full. When it is determined that the recycled-ink tank 41 has not become full (S170:N), ink suction is continued. When it is determined that the recycled-ink tank 41 has become full (S170:Y), the process goes back to S110.

On the other hand, if it is determined that the ink cartridge 31 has not been replaced and the ink has not been replenished (S150:N), the process is finished.

In the recycled-ink priority recording mode, image recording is performed with recycled-ink RK when there is stored recycled-ink RK. If there isn't any recycled-ink RK, image recording is performed with unused-ink K. Recycled-ink RK is used on a priority basis. Therefore, image recording can be performed wherein ink saving is emphasized.

In the above explanation of the process for the recycled-ink priority recording mode, the inkjet recording apparatus 1 is provided with only one recording head R for ink RK as a recording head for recycled-ink. However, it is possible to apply this process to a case, such as shown in FIG. 5, wherein the inkjet recording apparatus 1 is respectively provided with heads R for the recycled-ink of inks K, C, M, and Y.

[Process for Unused-Ink Priority Recording Mode]

As shown in FIG. 11, in S200, it is determined whether or not a command to initiate image recording is received by, for example, receiving image data. If it is determined that a command to initiate image recording has not been received (S200:N), this step is repeated.

When it is determined that a command to initiate image recording has been received (S200:Y), the process proceeds to S210. In S210 it is determined whether or not unused-ink (K) remains based on information regarding the ink remaining amount in the ink cartridge 31, detected by the ink remaining amount detection sensor 82, and information regarding the ink level in the sub-tank in the head V 51, detected by the ink level detection sensor 83. When it is determined that unused-ink (K) remains (S210:Y), in S220 image recording with the head V 51 is initiated wherein unused-ink (K) is used.

If it is determined that unused-ink (K) does not remain (S210:N), the process proceeds to S230. In S230 it is determined whether or not recycled-ink (RK) remains based on information regarding the ink remaining amount in the recycled-ink tank 41, detected by the ink remaining amount detection sensor 82, and information regarding the ink level in the sub-tank in the head R 61, detected by the ink level detection sensor 83. When it is determined that recycled-ink (RK) remains (S230:Y), in S240 image recording is initiated with the head R 61 wherein recycled-ink RK is used.

If it is determined that recycled-ink (RK) does not remain (S230:N), the process proceeds to S250. In S250 it is determined whether or not the ink cartridge 31 has been replaced and the ink K has been replenished.

The determination in S250 may be made based on specific information described below. That is, for example, this determination may be made based on at least one of information detected by the ink remaining amount detection sensor 82 regarding a change in the ink remaining amount inside of the ink cartridge 31, and information detected by the ink level detection sensor 83 regarding a change in the position of the surface of the ink reserved in the sub-tank inside of the head V 51.

When it is determined that the ink cartridge 31 has been replaced and the ink K has been replenished (S250:Y), in 260 the ink is drawn by the first pump 72*c* from the respective heads V 51-54. The ink drawn by the first pump 72*c* is supplied to the recycled-ink tank 41.

Subsequently, in S270 it is determined whether or not the recycled-ink tank 41 has become full. When it is determined that the recycled-ink tank 41 has not become full (S270:N), ink suction is continued. When it is determined that the recycled-ink tank 41 has become full (S270:Y), the process goes back to S210.

In S250, if it is determined that the ink cartridge 31 has not been replaced and the ink K has not been replenished (S250:N), the process is finished.

In the unused-ink priority recording mode, image recording is performed with unused-ink K when there is stored unused-ink K. If there isn't any unused-ink K, image recording is performed with recycled-ink RK. Unused-ink K is used on a priority basis. Therefore, image recording can be performed wherein the image quality is emphasized.

In the above explanation of the process for unused-ink priority recording mode, the inkjet recording apparatus 1 is provided with only one recording head R for ink RK as a recording head for recycled-ink. However, it is possible to apply this process to a ease, such as shown in FIG. 5, wherein the inkjet recording apparatus 1 is respectively provided with heads R for the recycled-ink of ink K, C, M, and Y.

[Effect]

The following effect can be achieved with the inkjet recording apparatus 1 according to the fourth embodiment. Excessive ink is timely discarded by the performance of the excessive ink disposal process. Therefore, recycled-ink does not overflow even when the amount of ink discharged and collected as a result of a maintenance operation is larger than the amount of recycled-ink consumed.

Moreover, the recycled-ink priority recording mode and the unused-ink priority recording mode can be suitably and flexibly selected depending on a situation. When, for instance, photo-image recording is performed, the unused-ink priority recording mode can be selected. When an other type of image recording is performed, such as text-image recording, the recycled-ink priority recording mode can be selected. Even when an ink, which is used in preference to other ink, runs out, the other ink can be conveniently used to perform image recording.

Furthermore, a user can select either of the recycled-ink priority recording mode and the unused ink priority recording mode by operating key-switches in the operation panel 29 (see FIG. 1). Image recording can be performed wherein various needs can be met when, for example, a user wishes high image quality or wishes to save as much ink as possible.

Additionally, for recording an image such as a facsimile-image or a text-image containing only text data, which can be sufficiently discriminable without a high image quality, as much as for a photo-image, the recycled-ink priority recording mode is automatically selected. Therefore, ink can preferably be saved.

Fifth Embodiment

Figure 17:
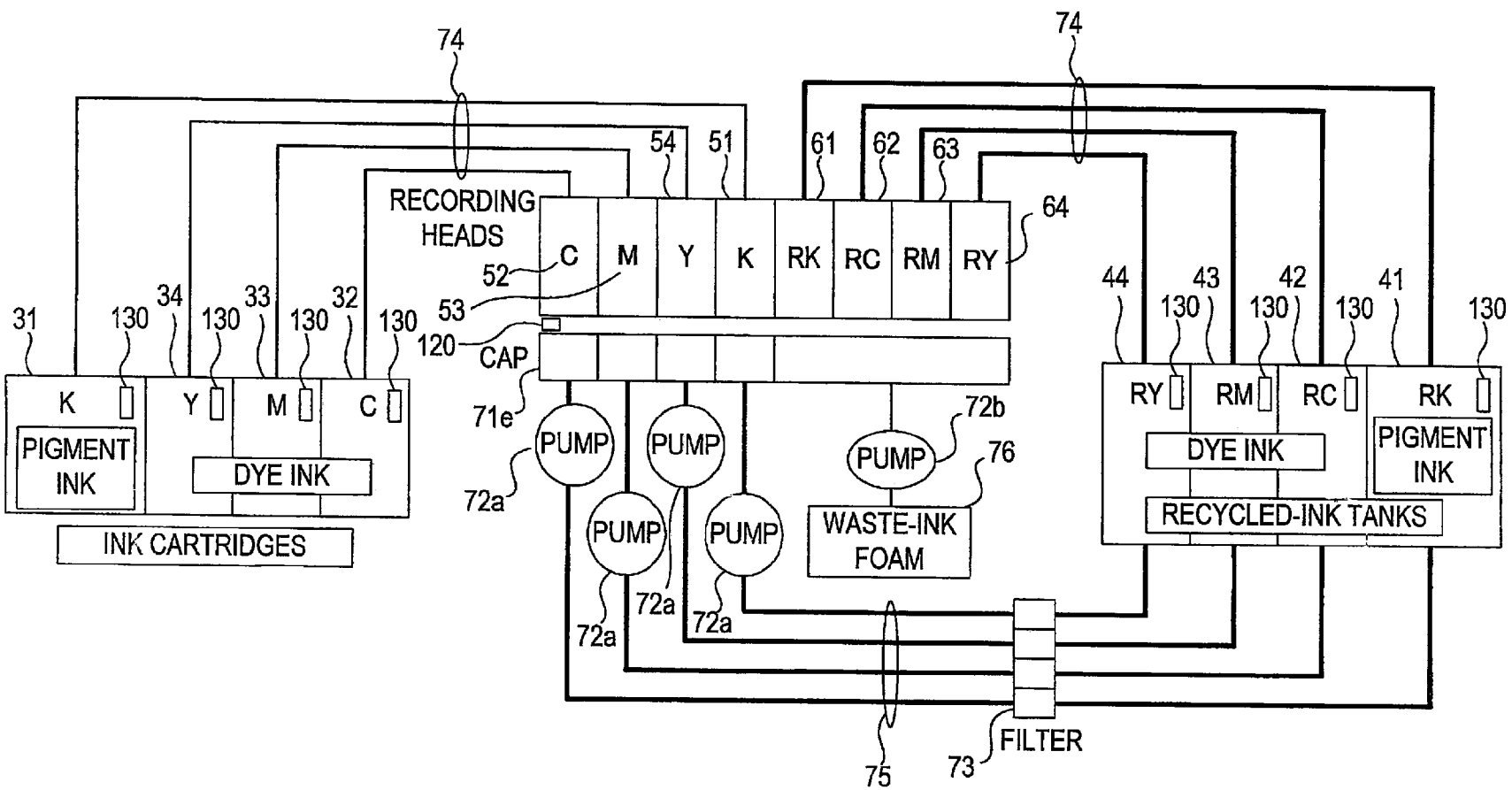
FIG. 17 is a block diagram showing a schematic structure of a main part of an inkjet recording apparatus according to a fifth embodiment of the present invention.

In FIG. 17, which schematically shows the substantial structure of an inkjet recording apparatus 1 according to a fifth embodiment, the same reference numbers are given to the same components as in the first embodiment shown in FIG. 2, the second embodiment shown in FIG. 6, the third embodiment shown in FIG. 8, and the fourth embodiment shown in FIG. 11.

The inkjet recording apparatus 1 according to the present embodiment is an inkjet recording apparatus wherein dye ink and pigment ink are both used for image recording.

Specifically, as shown in FIG. 12, the inkjet recording apparatus 1 includes ink cartridges 31, 32, 33, and 34, and recycled-ink tanks 41, 42, 43 and 44. The ink cartridge 31 stores unused pigment ink K in the aforementioned ink reservoir unit. Each of the ink cartridges 32-34 stores one of unused dye inks C, M, and Y. Each of the recycled-ink tanks 41-44 stores one of the recycled-inks RK, RC, RM, and RY. The inkjet recording apparatus 1 is furthermore provided with recording heads V 51, 52, 53, and 54 respectively for ink K, C, M, and Y, and recording heads R 61, 62, 63, and 64 respectively for ink RK, RC, RM, and RY, on a carriage in the aforementioned recording unit. The inkjet recording apparatus 1 is still furthermore provided with a cap 71*e*, pumps 72*a*, a pump 72*b*, a filter 73, collected-ink paths 75, and a waste-ink foam 76, in the aforementioned maintenance unit. Additionally, the inkjet recording apparatus 1 is provided with ink supply tubes 74.

The cap 71*e* is configured so as to separately receive ink discharged from the respective heads V 52-54 for ink C, M, and Y, and to receive both of ink discharged from the head V 51 for ink K and the head R 61 for ink RK together. The cap 71*e* is also configured so as to receive ink discharged from the respective heads R 62-64 for recycled-ink RC, RM, and RY together in bulk.

Ink C, M, and Y, and, ink K and RK are respectively discharged into the cap 71*e* from corresponding heads V 51-54 and head R 61 during a maintenance operation, and collected separately by the pumps 72*a*. Collected ink flows in respective collected-ink paths 75, passes through the filter 73, and is stored in the respective recycled-ink tanks 41-44.

On the other hand, ink RC, RM, and RY, discharged into the cap 71*e* from respective heads R 62-64 during a maintenance operation, is collected together in bulk by the pump 72*b*. The collected ink is discarded into the waste-ink foam 76 and absorbed therein.

In the inkjet recording apparatus 1 according to the present embodiment, dye ink and pigment ink can be reused independently from each other without being mixed together.

It is to be noted that the inkjet recording apparatus 1 of the present embodiment has the same electric structure as the electric structure shown in FIG. 7.

Although some embodiments of the present invention are described above, the present invention is not limited to these embodiments. Variations and modifications are possible within the scope of the invention. Specific examples will be given below.

(1) Recycled-ink is different from unused-ink in various physical properties, such as density or surface tension, as the diluting-fluid contained in the ink volatilizes. In order to perform suitable image recording, the ejection of recycled-ink from the nozzles needs to be controlled differently from the ejection of unused-ink. For this purpose, the frequencies of energy application onto the ink so as to drop the ink from the nozzles (to be referred to as drive frequencies) in the heads R and the heads V may be changed. For example, the frequencies of energy application can be changed by making the control unit 100 control the drive circuit 118 which transmits a control signal to the heads R and the heads V (see FIGS. 5, 7, 10, and 12). Specifically, in the heads R, the drive frequency for the ejection of recycled-ink may be a little less than the drive frequency for the ejection of unused-ink in the heads V. The differences in the drive frequencies may be obtained from an experiment or calculation in consideration of the expected density or viscosity of recycled-ink. The drive frequencies are preferably set in consideration of characteristics of various drive methods, such as a drive method wherein energy to drop ink is applied in the form of heat, or a drive method wherein the energy is applied in the form of pressure by piezoelectric elements.

(2) In regard to the wiping operation performed in the maintenance unit, the movement of a blade, which wipes the nozzle surfaces of recording heads, may be controlled in a manner so that the wiping of the nozzle surfaces of the heads V is performed prior to the wiping of the nozzle surfaces of the heads R. For example, this kind of wiping becomes possible by making the control unit 100 control the drive circuit 122 which transmits a control signal to the blade 120 (see FIGS. 2, 5-8, 10-12, and 17). Specifically, for the disposition of recording heads as shown in FIG. 2, the blade 120 may be controlled to wipe the nozzle surfaces in the order of Y, M, C, K, and then RK.

With this wiping order, it is possible to inhibit the blade from carrying contaminants from the nozzle surfaces of the heads R to the nozzle surfaces of the heads V.

(3) An ink remaining amount indicator may be provided for both unused-ink and recycled-ink. In this case, a user can check not only the remaining amount of unused-ink, but also the remaining amount of recycled-ink. If a user can check that recycled-ink still remains, even when unused-ink runs out, the user does not need to replenish unused-ink in haste. This is convenient for a user. Specifically, a check window 130, which enables a visual check of whether or not ink remains, can be provided on each ink cartridge and recycled-ink tank (see FIGS. 2, 6, 8, 11, and 17). Alternatively, the remaining amount of each ink can be displayed on the LCD of the operation panel 29 (see FIG. 1) based on information regarding the ink remaining amount detected by the ink remaining amount detection sensor 82 and the ink level detection sensor 83, shown in FIG. 12.

(4) For test recording, which is performed in order to check the ink ejection state of each recording head, the inkjet recording apparatus 1 may be constituted in a manner so that ink is ejected not only from the heads V but also from the heads R. For example, this kind of test recording can be performed by making the control unit 100 control the drive circuit 118 which transmits a control signal to the heads R and the heads V (see FIGS. 5, 7, 10, and 12). This structure enables a user not only to check the ink ejection state of the heads R, but also to check the coloration of the recycled-ink. Recycled-ink can be checked for whether or not the ink has a suitable quality for use.

What is claimed is:

1. An inkjet recording apparatus that records an image on a recording medium comprising:

at least one recording head for unused-ink having a nozzle array made of a plurality of nozzles that only ejects unused-ink;

at least one recording head for recycled-ink having a nozzle array made of a plurality of nozzles that ejects recycled-ink of an equivalent color to the unused-ink ejected from the at least one recording head for unused-ink;

a collector that collects ink discharged from the at least one recording head for unused-ink and the at least one recording head for recycled-ink; and a recycled-ink supplier that supplies the ink, collected by the collector, to the at least one recording head for recycled-ink as the recycled-ink, wherein the collector separately collects ink, discharged from the at least one recording head for unused-ink, and ink, discharged from the at least one recording head for recycled-ink, and discards the ink discharged from the at least one recording head for recycled-ink.

2. An inkjet recording apparatus that records an image on a recording medium comprising:

at least one recording head for unused-ink having a nozzle array made of a plurality of nozzles that only ejects unused-ink;

at least one recording head for recycled-ink having a nozzle array made of a plurality of nozzles that ejects recycled-ink of an equivalent color to the unused-ink ejected from the at least one recording head for unused-ink;

a collector that collects ink discharged from the at least one recording head for unused-ink and the at least one recording head for recycled-ink;

a recycled-ink supplier that supplies the ink, collected by the collector, to the at least one recording head for recycled-ink as the recycled-ink;

a viscosity detector that detects a viscosity of the recycled-ink;

a diluting-fluid adder including nozzles for ejecting diluting-fluid so as to dilute ink; and a diluting-fluid controller that controls the diluting-fluid adder, wherein the diluting-fluid controller controls the diluting-fluid adder so as to eject diluting-fluid from the diluting-fluid nozzles and add the diluting-fluid into recycled-ink when the viscosity of the recycled-ink, discharged from one of the at least one recording head for unused-ink and the at least one recording head for recycled-ink in order to restore the ejectable state, is higher than a predetermined value, wherein the at least one recording head for unused-ink, the at least one recording head for recycled-ink, and the diluting-fluid adder are mounted on a carriage that is reciprocated in a direction perpendicular to a conveyance direction of a recording medium for image recording, wherein the at least one recording head for recycled-ink is provided with a sub-tank that reserves recycled-ink, and wherein the sub-tank stores a stirring member that is urged by the reciprocation of the carriage, moves within the sub-tank, and stirs the recycled-ink.

3. An inkjet recording apparatus that records an image on a recording medium comprising:

at least one recording head for unused-ink having a nozzle array made of a plurality of nozzles that only ejects unused-ink;

at least one recording head for recycled-ink having a nozzle array made of a plurality of nozzles that ejects recycled-ink of an equivalent color to the unused-ink ejected from the at least one recording head for unused-ink;

a collector that collects ink discharged from the at least one recording head for unused-ink and the at least one recording head for recycled-ink;

a recycled-ink supplier that supplies the ink, collected by the collector, to the at least one recording head for recycled-ink as the recycled-ink;

an ink detector that respectively detects existence/nonexistence of the unused-ink and the recycled-ink; and an ejection controller that controls ejection of the unused-ink from the at least one recording head for image recording, and ejection of the recycled-ink from the at least one recording head for image recording, wherein the ejection controller controls ink ejection so as to selectively perform image recording in:

a recycled-ink priority recording mode wherein image recording is performed with the recycled-ink stored in the at least one recording head for recycled-ink in preference to the unused-ink when existence of the recycled-ink is detected by the ink detector, and image recording is performed with the unused-ink stored in the at least one recording head for unused-ink when nonexistence of the recycled-ink is detected by the ink detector; and an unused-ink priority recording mode wherein image recording is performed with the unused-ink stored in the at least one recording head for unused-ink in preference to the recycled-ink when existence of the unused-ink is detected by the ink detector, and image recording is performed with the recycled-ink stored in the at least one recording head for recycled-ink when nonexistence of the unused-ink is detected by the ink detector.

4. The recording apparatus as set forth in claim 3 further comprising a selector with which a user selects one of the recycled-ink priority recording mode and the unused-ink priority recording mode.

5. The inkjet recording apparatus as set forth in claim 4 wherein the ejection controller controls the ink ejection so as to perform image recording in accordance with one of the recycled-ink priority recording mode and the unused-ink priority recording mode selected by use of the selector.

6. The inkjet recording apparatus as set forth in claim 3, wherein the inkjet recording apparatus works as a printer and a facsimile, and wherein the ejection controller controls the ink ejection so as to perform image recording in the recycled-ink priority recording mode when the inkjet recording apparatus works as a printer for text-image recording, and when the inkjet recording apparatus works as a facsimile for image recording.

7. The inkjet recording apparatus as set forth in claim 3, wherein the inkjet recording apparatus works as a printer, and wherein the ejection controller controls the ink ejection so as to perform image recording in the unused-ink priority recording mode when the inkjet recording apparatus works as a printer for photo-image recording.

8. An inkjet recording apparatus that records an image on a recording medium comprising:

at least one recording head for unused-ink having a nozzle array made of a plurality of nozzles that only ejects unused-ink;

at least one recording head for recycled-ink having a nozzle array made of a plurality of nozzles that ejects recycled-ink of an equivalent color to the unused-ink ejected from the at least one recording head for unused-ink;

a collector that collects ink discharged from the at least one recording head for unused-ink and the at least one recording head for recycled-ink;

a recycled-ink supplier that supplies the ink, collected by the collector, to the at least one recording head for recycled-ink as the recycled-ink; and tubes through which the unused-ink and the recycled-ink are respectively supplied to the recording head for unused-ink and the recording head for recycled-ink, wherein the tube through which the recycled-ink is supplied to the recording head for recycled-ink has a diameter larger than a diameter of the tube through which the unused-ink is supplied to the recording head for unused-ink, and wherein nozzles of the recording head for recycled-ink have a diameter larger than a diameter of nozzles of the recording head for unused-ink.

9. An inkjet recording apparatus that records an image on a recording medium comprising:

at least one recording head for unused-ink having a nozzle array made of a plurality of nozzles that only ejects unused-ink;

at least one recording head for recycled-ink having a nozzle array made of a plurality of nozzles that ejects recycled-ink of an equivalent color to the unused-ink ejected from the at least one recording head for unused-ink;

a collector that collects ink discharged from the at least one recording head for unused-ink and the at least one recording head for recycled-ink;

a recycled-ink supplier that supplies the ink, collected by the collector, to the at least one recording head for recycled-ink as the recycled-ink;

a wiper that wipes and cleans nozzle surfaces of the at least one recording head for unused-ink and the at least one recording head for recycled-ink, wherein the wiper performs wiping of the nozzle surface of the at least one recording head for unused-ink prior to wiping of the nozzle surface of the at least one recording head for recycled-ink; and a wiping controller that controls the wiper, wherein the wiping controller controls the wiper so as to perform the wiping of the nozzle surface of the at least one recording head for unused-ink prior to the wiping of the nozzle surface of the at least one recording head for recycled-ink.

* * * * *

UNITED STATES PATENT AND TRADEMARK OFFICE

CERTIFICATE OF CORRECTION

PATENT NO. : 7,648,224 B2
APPLICATION NO. : 11/380866
DATED : January 19, 2010
INVENTOR(S) : Sasa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 707 days.

Signed and Sealed this

Twenty-eighth Day of December, 2010

David J. Kappos

David J. Kappos
*Director of the United States Patent and Trademark Office*